US011992081B2

(12) United States Patent
Issler

(10) Patent No.: US 11,992,081 B2
(45) Date of Patent: May 28, 2024

(54) REVERSIBLE MULTI-PURPOSE LINER

(71) Applicant: Columbia Insurance Company, Omaha, NE (US)

(72) Inventor: James Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 125 days.

(21) Appl. No.: 17/323,442

(22) Filed: May 18, 2021

(65) Prior Publication Data

US 2021/0267305 A1 Sep. 2, 2021

Related U.S. Application Data

(63) Continuation of application No. 16/000,445, filed on Jun. 5, 2018, now abandoned.

(60) Provisional application No. 62/516,179, filed on Jun. 7, 2017.

(51) Int. Cl.

| | |
|---|---|
| ***A43B 17/00*** | (2006.01) |
| ***A43B 3/00*** | (2022.01) |
| ***A43B 3/24*** | (2006.01) |
| ***A43B 7/1405*** | (2022.01) |
| ***A43B 13/12*** | (2006.01) |
| ***A43B 13/18*** | (2006.01) |
| ***A43B 17/03*** | (2006.01) |
| ***A43B 17/18*** | (2006.01) |

(52) U.S. Cl.

CPC ..... *A43B 13/12* (2013.01); *A43B 3/0078* (2013.01); *A43B 3/246* (2013.01); *A43B 7/1405* (2013.01); *A43B 13/181* (2013.01); *A43B 17/003* (2013.01); *A43B 17/03* (2013.01); *A43B 17/18* (2013.01)

(58) Field of Classification Search

CPC ..... A43B 1/0045; A43B 7/146; A43B 7/1465; A43B 7/34; A43B 13/226; A43B 17/003; A43B 17/006; A43B 17/026; A43B 17/03; A43B 17/18

See application file for complete search history.

(56) References Cited

U.S. PATENT DOCUMENTS 2,641,068 A * 6/1953 Thompson ..... A43B 17/006 36/44
4,557,060 A * 12/1985 Kawashima ..... A43B 17/00 36/44
5,381,610 A * 1/1995 Hanson ..... A43B 3/24 36/102

(Continued)

*Primary Examiner* — Sharon M Prange

(74) *Attorney, Agent, or Firm* — IP Attorneys Group, LLC

(57) ABSTRACT

A multi-sided, multi-purpose liner is provided for use in footwear. Each side of the liner provides one or more benefits to the wearer. The liner is reversible, such that a first side with a first benefit can contact the wearer's foot or a second side with a second benefit can contact the wearer's foot. The wearer can flip or rotate the liner so that the side having the desired benefit contacts their foot during use. One side of the liner may include a plurality of benefits in a preselected pattern across the surface. A liner kit provides a material blank from which the liner may be cut to produce a desired distribution of benefits. The benefits of the liner may vary with respect to the location on the surface of the liner, with some areas of the liner displaying an increased or decreased degree of a specific benefit.

12 Claims, 17 Drawing Sheets

(56) References Cited

U.S. PATENT DOCUMENTS

| | | | | |
|---|---|---|---|---|
| 5,551,173 | A * | 9/1996 | Chambers | A43B 7/146 36/141 |
| 6,035,554 | A * | 3/2000 | Duncan | A43B 13/28 36/15 |
| 10,130,504 | B1 * | 11/2018 | Matthews | A43B 7/1475 |
| 2006/0277796 | A1 * | 12/2006 | Gallegos | A43B 17/02 36/44 |
| 2007/0051018 | A1 * | 3/2007 | Issler | A43B 9/02 36/29 |
| 2008/0040952 | A1 * | 2/2008 | Celia | A43D 999/00 36/43 |
| 2009/0126226 | A1 * | 5/2009 | Morita | A43B 17/026 36/43 |
| 2014/0082966 | A1 * | 3/2014 | Neiley | A43B 7/144 36/88 |
| 2014/0250721 | A1 * | 9/2014 | Marriner | A43B 17/102 36/44 |
| 2016/0128423 | A1 * | 5/2016 | Shibata | A43B 13/127 36/28 |
| 2017/0295885 | A1 * | 10/2017 | Stern | F16F 15/04 |

* cited by examiner

REVERSIBLE MULTI-PURPOSE LINER

CROSS REFERENCE TO RELATED APPLICATIONS

This application is a continuation application of U.S. Non-Provisional patent application Ser. No. 16/000,445, filed Jun. 5, 2018 and titled "Reversible Multi-Purpose Liner," which claims priority to and benefit of U.S. Provisional Patent Application No. 62/516,179, filed Jun. 7, 2017 and titled "Reversible Multi-Purpose Liner". The contents of the above-identified Applications are relied upon and incorporated herein in their entirety by reference.

BACKGROUND OF INVENTION

Shoe inserts, insoles, and sock liners are known in the art to provide cushion, support, comfort, and other benefits to the wearer of a shoe. Such inserts may be permanent or replaceable and may provide a variety of benefits to a user of the shoe depending on the application. For example, a wearer of the shoe may require one type of benefit for one activity, and may require another type of benefit for a different activity. A runner may require a shoe liner with front-to-back cushioning for weight transfer during long distance runs, and a basketball player may require a shoe liner with added side-to-side support to prevent ankle roll during quick swivel and pivot moves. Further, a dancer may require yet another type of benefit, and a casual wearer may require a different type of benefit. One problem with known liners is that they are only able to provide one benefit to the user of the shoe, and achieving a second benefit necessitates the implementation of a different sock liner to accommodate the second benefit.

Further, with regards to the prior art, structures for absorbing and dispersing mechanical energy are also usually incorporated into shoes, sporting goods, clothing, protective equipment, vehicles, and the like to provide user comfort and safety. Such structures typically absorb and distribute kinetic energy to prevent damage or discomfort resulting from impacts. These structures may include football helmets, crash helmets, ballistic vests, and the like to minimize damage from energetic impacts.

Some energy absorbing and dispersing structures may be fabricated from polymeric foam materials of either the open or closed cell type. In other instances, such structures can be bodies of fibrous materials. Yet other instances may employ springs, pistons, and the like to be used as energy dispersing devices.

Shoes that typically employ a foam material often have a higher degree of resiliency. This can be accomplished by utilizing a relatively stiff open cell foam structure, or by going to a closed cell foam, or other such structure which possibly includes sealed air pockets. In either instance, the stiffer sole may provide adequate cushioning for high shock levels but is often rigid under low shock conditions, which could compromise comfort.

Some shoes known in the art may involve a variety of inflation devices disposed at different locations. For instance, previous shoe arrangements may have included soles that can be inflated at the arch to provide support. Other shoes typically have sealed inflated chambers disposed within the soles in order to increase vertical bounce. Such prior art shoes may not allow for selective adjustment of the pressure in the bladder chambers and may result in uneven air distribution in the sole of the shoe.

Moreover, if an impact force applied to such a structure exceeds its operational range, the structure may bottom out. In some instances, the structure will undergo irreversible break down. Bottoming out often occurs when a structure can absorb no more energy and ceases to provide any protection. For example, soles of shoes often include energy absorbing structures fabricated from open cell foam materials. However, when high levels of force are applied to these materials, as for example when the wearer jumps, runs, or stumbles, the cellular structure of the material typically flattens, and the innersole may bottom out allowing a jarring shock to be transmitted to a wearer's foot. Hence, the inflation device may be acceptable under low shock conditions but unacceptable, due to the bottoming out, under high shock conditions.

This bottoming out can be alleviated by providing a thicker body of foam material. However, such increases in thickness are generally unacceptable in footwear due to increase in bulk and instability. Furthermore, using a thicker body of foam in the sole of a shoe usually produces discomfort and fatigue.

Pumps in some prior art shoes have typically been either externally connectable to the shoe's air chambers or positioned in low stress areas on the upper portion of the shoe, such as in the tongue or on the back of the heel. For externally connectable pumps, the pump must be retrieved whenever inflation is desired. Pumps positioned on the upper portion possibly add bulk to the shoe and could limit agility. Such pumps also tend to inhibit aesthetic choices in shoe design.

U.S. Pat. No. 4,217,705 to Donzis appears to relate to an air filled chamber created by a top sheet and a bottom sheet sealed together around the entire periphery. The top and bottom sheets may be sealed together in select areas within the perimeter of the periphery to create a series of compartments that are in fluid connection with one another. Because the compartments may be in fluid communication with one another, a single type of fluid seems to be used to fill all compartments.

U.S. Pat. No. 4,446,634 to Johnson, U.S. Pat. No. 5,987,781 to Pavisi, U.S. Pat. No. 5,813,142 to Demon, U.S. Pat. No. 6,519,873 to Buttigieg, and U.S. Pat. No. 6,725,573 to Doyle appear to relate to a shoe with one or more chambers where all chambers have a single type of fluid contained within the chambers. In some of these references that have more than one chamber, the chambers seem to be spaced apart from one another.

What is needed, therefore, is a shoe with a cushioning device that has improved comfort and safety. Another desire is a shoe with a cushioning device that resists bottoming out. A further desire is a shoe with a cushioning device that permits adjustment to the cushioning device so that the shoe remains flexible during low shock conditions and is sufficiently rigid during high shock conditions. What is further needed is a liner that provides multiple benefits to the user of the shoe, via a single liner that accommodates multiple benefits. Such a liner allows the wearer of the shoe to reconfigure the liner to provide benefits for another activity, without having to carry around multiple extra liners. Finally, what is needed is a reversible liner with improved cushioning as outlined above.

SUMMARY OF INVENTION

This invention is directed to a multi-sided, multi-purpose liner, more specifically a sock liner for use in shoes, boots, sneakers, and other footwear. It is an object of this invention to provide a sock liner with two sides. It is also an object of this invention to provide a sock liner that is fitted to either a left or right shoe of any marketed size. It is an object of this invention to provide a sock liner for absorbing moisture from body activities and functions. It is another object of this invention to provide a sock liner for storing and dissipating body fluids and moisture, generated by the body or from body functions or other sources. It is another object of this invention to provide a sock liner for overcoming odors and the other noxious effects caused by such fluids and moisture during the generation thereof. It is another object of this invention to provide a sock liner having a bactericide to kill germs generated by bodily fluids or other moisture. It is another object of this invention to provide a sock liner for increasing a wearer's comfort during use. It is another object of this invention to provide a sock liner for massaging a wearer's foot during use. It is another object of this invention to provide a sock liner for improving a wearer's posture. It is another object of this invention to provide a sock liner having multiple properties or benefits.

It is an object of this invention to provide a sock liner having multiple properties or benefits to the wearer. In one embodiment of this invention, the sock liner has two sides, each side including a flat surface for contacting a wearer's foot. Each side of the sock liner includes a material for proving at least one of the following benefits: absorbing moisture; storing and dissipating moisture; overcoming odors; providing a bactericide to kill germs; increasing comfort; improving posture; massaging a wearer's foot; and providing additional traction, among other things. In one embodiment, the sock liner is made up of two sides, each side including a material having a similar property or benefit. In another embodiment, the sock liner is made up of two sides, each side including a material having a different property or benefit.

In one embodiment, each side of the sock liner includes a material having different properties or benefits to the wearer. The sock liner is reversible. A first side having a first property can contact the wearer's foot or a second side having a second property can contact the wearer's foot. Depending on the benefit or property the wearer seeks to achieve from the sock liner, the wearer can flip or rotate the sock liner so that the desired side having the desired property or benefit contacts the wearer's foot during use.

In another embodiment of this invention, the sock liner is shaped to fit either a left foot or a right foot of a wearer. The sock liner is shaped to fit within footwear shaped for a right foot. The sock liner is also shaped to fit within footwear shaped for a left foot. Sometimes a wearer requires different sock liner properties or benefits for each of the right foot and the left foot, and so using two different sock liners with different properties may be necessary. Depending on the benefit or property the wearer seeks to achieve, a wearer can interchange the sock liner between the right foot and the left foot. Each sock liner further includes two reversible sides, each side having a different property or benefit to the wearer, providing a maximum of four possible, differing properties or benefits to the wearer.

In one embodiment of this invention, one side of the sock liner is made of hydrophilic foam to facilitate absorbing, adsorbing, transferring, gelling or storing and dissipating body fluids generated by the body or body functions and other moisture.

In another embodiment of this invention, one side of the sock liner is made of a non-woven fiber or a felted non-woven fiber material to provide softness, increasing a wearer's comfort. The fiber material has a hardness of approximately 0-35 measured on the Shore Durometer Scale O.

In another embodiment of this invention, one side of the sock liner is made of rubber, silicone, or another elastic polymer to provide hardness, improving a wearer's posture. The side of the sock liner has a hardness of approximately 36-70 measured on the Shore Durometer Scale O.

In another embodiment of this invention, one side of the sock liner is a material that includes additives for providing a bactericide to kill germs generated by the body fluids or in the other moisture absorbed, adsorbed, gelled or stored and dissipated by the sock liner.

In another embodiment of this invention, one side of the sock liner is a material that includes additives for overcoming and reducing odors and germs.

In another embodiment of this invention, one side of the sock liner includes glycerin or a gel-type material for massaging a wearer's foot when in use. The glycerin or gel-type material also aides in absorbing and mitigating the force from impacts during use.

In another embodiment of this invention, one side of the sock liner includes a plurality of properties or benefits in a preselected pattern and orientation across the surface, such that cutting the sock liner in different orientations to fit into the footwear it is intended to cover will provide varying patterns of properties or benefits across the sock liner. This objective is achieved by providing a sock liner kit including a sock liner that is larger in length and width than the length and width of a sock liner receiving area of the footwear, thus allowing the same sock liner to be cut to fit either the left-foot footwear or the right-foot footwear and to completely cover the sock liner receiving area of only the footwear which it is cut to fit. In some embodiments, the sock liner has a margin which matches the distal margin of the sock liner receiving area of the footwear. The distal margin of the sock liner receiving area of the footwear extends laterally across the footwear at the rear of the sock liner receiving area. In some embodiments the distal margin is a single feature extending laterally across the entire sole of the footwear. In other embodiments, the distal margin is established by a series of features disposed laterally across the sole of the footwear.

In some embodiments, the property or benefit of the sock liner varies with respect to its location on surface of the sock liner, with some areas of the sock liner displaying an increased or a decreased degree of the specific property or benefit. In some embodiments, aligning the margin of the sock liner to the distal margin of the sock liner receiving area of the footwear establishes the geometry and distribution of the property or benefit with respect to the footwear.

In some embodiments, the property or benefit of the sock liner is substantially uniform at all points along the surface. In other embodiments, the property or benefit of the sock liner varies with respect to position along the surface. For example, a surface may incorporate a smooth surface in one location and a rougher surface in another location. This results in a positionally variable property or benefit of the sock liner, wherein the property or benefit of the sock liner varies with respect to location on the sock liner surface, and the amount of weight centered over each portion of the surface and shifts in weight caused by rolling the foot or leaning the body will result in changes to the property or benefit of the sock liner.

In one embodiment, the surface of the sock liner includes a series of concentric curves such that the property or benefit is higher in response to a force directed inward or outward from the curve and lower in response to a force directed along the arc of the curve.

Additionally, some wearers might prefer a sock liner having positionally variable properties or benefits having a higher degree of the property or benefit at the rear portion of the surface and a lower degree of the property or benefit at the forward portion of the surface, while other wearers might prefer a higher degree of the property or benefit at the forward portion and a lower degree of the property or benefit at the rear portion of the surface.

In one embodiment, the distal margin of the sock liner receiving area is in the shape of an arc of a circle, and the sock liner periphery includes an edge defining a larger arc of a circle of the same radius, so that any portion along the arc of the sock liner periphery forms a sock liner margin suitable for matching the shape of the distal margin. This embodiment is advantageous for allowing the wearer to customize the orientation of a sock liner having directionally variable property or benefit to match his or her desired objectives. The exact orientation of the directionally variable property or benefit can be selected by rotating the sock liner margin against the distal margin, and when the desired orientation is achieved, the excess sock liner material is marked and removed. The resulting sock liner is easily removed and reattached without altering the orientation of the directionally variable benefit relative to the footwear by indexing the margin with the distal margin and the side of the sock liner with the periphery of the sole.

In one embodiment, at least one member on the surface of the sock liner facilitates the above described properties or benefits. The member can be a series of ridges, grooves, geometric shapes, embroidered patterns, or any other useful structure that can provide tactile feedback to the wearer, which is known to one of ordinary skill in the art. In one embodiment, the member is raised a height in relation to the surface of the sock liner. In another embodiment, the member is grooved into the surface of the sock liner, creating an indent or series of indents. In another embodiment, the member includes both a raised height and an indented groove.

In one embodiment, the member extends both in lateral and longitudinal directions for spreading the property or benefit toward a periphery of the sock liner.

In another embodiment, the member follows a contour of a wearer's toes for facilitating the property or benefit in the area of the toes. In another embodiment, the member is grooved and spaced apart from the wearer's foot.

In further embodiments, the sock liner has a second member extending around a grooved area, wherein the grooved area is spaced apart from the wearer's foot.

In other embodiments, the member includes a general shape selected from the group consisting of a V shape, a U shape, a Y shape, a W shape, an X shape, a circular shape, a triangular shape, a saw tooth shape, a polygonal shape, and combinations thereof.

In some embodiments, the member extends in a generally diagonal direction. In other embodiments, the member bisects the sock liner for facilitating the property or benefit about an axis passing longitudinally through the sock liner.

In another embodiment, the material providing the property or benefit is located on one side of the first member. In a further embodiment, the material providing the property or benefit is located on a second side of the first member.

It is also an object of the invention to provide a shoe that has an improved cushioning device.

Another object is a cushioning device that allows its physical properties to be varied in accordance with the intended use of the shoe.

A further object of the invention is to provide a cushioning device that includes separable internal chambers so that various fluids may be placed inside the chambers.

Yet another object is a cushioning device that provides continuous cushioning during transition from one chamber to a next chamber.

A still further object is a cushioning device that controls a fluid's movement during compression of the cushioning device so that the area of the cushioning device experiencing the compression resists complete decompression.

These and other objects are achieved by a shoe for cushioning a wearer's foot having an outsole, an upper, and a bladder adapted to receive the foot and being placed between the outsole and the upper. The bladder further has a first chamber and a second chamber, where the first chamber is in contact with the second chamber for providing continuous cushioning. The bladder is also removably placed between the upper and outsole. In other aspects of the invention, the bladder is integrally placed between the upper and outsole.

In some embodiments, the shoe has a first filler removably placed within the first chamber and the first filler includes a property selected from the group consisting of a user determined density, a user determined volume, a user determined weight, a user determined texture, a user determined consistency, and combinations thereof.

In other embodiments, the shoe has a baffle placed within the first chamber. In further embodiments, an auxiliary sockling is placed on top of the bladder for receiving a wearer's foot.

In yet another embodiment, a distance between the first and second chambers is fixed. In some of these embodiments, the first chamber is adjacent to the second chamber.

In some other embodiments, a plurality of chambers and a plurality of fillers are provided, each filler corresponding to a chamber.

In another aspect of the invention, a shoe for cushioning a wearer's foot includes an outsole, an upper, and a bladder adapted to receive the foot and being placed between the outsole and the upper. The bladder also includes a first chamber and a second chamber, where the first chamber is adjacent to the second chamber for continuous cushioning and where the first chamber includes a first filler that is different than a second filler that is within the second chamber.

In some embodiments, a plurality of chambers and a plurality of fillers are provided, each filler corresponding to a chamber and where each filler is different from a next filler.

In other embodiments, the bladder includes a top sheet and a bottom sheet, where the top and bottom sheets are sealed together along a periphery of the top and bottom sheets. In some of these embodiments, the bladder includes a baffle for inhibiting movement of a first filler.

The baffle is a contact point between the top and bottom sheets within the periphery of the top and bottom sheets. In another embodiment, the baffle includes a wall with a top end connected to the top sheet and a bottom end connected to the bottom sheet. In addition to or instead of the above, the baffle is a permeable membrane.

In a more specific aspect of the invention, a bladder includes a top sheet having a periphery, a bottom sheet having a periphery, the top sheet being in contact with the bottom sheet along the peripheries of the top and bottom sheets, and where the top sheet is in contact with the bottom sheet in a localized area for defining a first chamber and a second chamber.

In some embodiments, the localized area extends across the top and bottom sheets from one side to an opposite side. Moreover, the first chamber includes an optional baffle for inhibiting movement of the first filler and/or the second filler. In some of these embodiments, the baffle is a contact point between the top and bottom sheets within the peripheries.

BRIEF DESCRIPTION OF FIGURES

A more complete understanding of the present invention may be derived by referring to the detailed description and claims when considered in conjunction with the following figures, wherein like reference numbers refer to similar elements throughout the figures.

DETAILED DESCRIPTION OF DRAWINGS

Figure 1A:
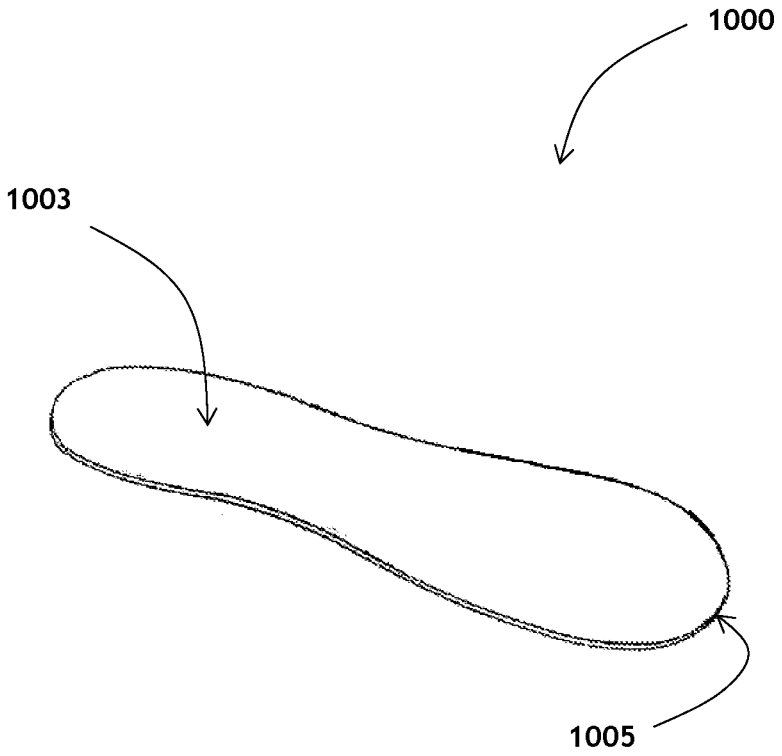
FIG. 1A depicts a liner in accordance with the invention.

FIG. 1A shows a sock liner 1000 in accordance with one embodiment of the invention. The sock liner has two sides, top side 1003, and bottom side 1005. Critical to this embodiment of the invention is the ability to reverse or flip the liner to its other side in order to enjoy a different benefit or attribute of the liner. For example, in one embodiment, top side 1003 is made of a slick or low friction material to allow the user's foot to comfortably orient itself within the cavity of the footwear, and to reorient itself as conditions change when the user walks. This side may be desirable, for example, when the user has a sore or injury on their foot that necessitates a loose or forgiving environment. Further in this embodiment, bottom side 1005 is made of a rough or abrasive material having a high coefficient of friction to hold the user's foot securely in position while walking or moving. This surface may be desirable when the user is participating in more rigorous activities that warrant a stable and supportive foundation. As will be appreciated, this embodiment of the invention provides a total of 2 benefits to the user, including a single benefit on each of top side 1003 and bottom side 1005.

In one embodiment, in order to secure liner 1000 within the footwear, regardless of which side is facing up or down, the liner 1000 is cut to fit snugly within the sock liner receiving area or cavity of the footwear, such that the profile of liner 1000 substantially matches the profile of the sock liner receiving area or cavity of the footwear. Alternatively, in another embodiment, both top side 1003 and bottom side 1005 of liner 1000 each form one part of a hook and pile fastener pair, while the other part of the hook and pile fastener pair is contained within the cavity of the footwear. In this embodiment, liner 1000 need not be cut to fit precisely within the footwear. For example, liner 1000 constitutes the piles of the hook and pile fastening pair, and the footwear constitutes the hooks of the hook and pile fastening pair. In this embodiment, top side 1003 has a tighter pile, or slicker pile, or both, and the bottom side 1005 has a coarser pile, or rougher pile, or both. Other mechanisms for securing the liner 1000 are also envisioned; however, as will be further discussed below. Additionally, in one embodiment the sock liner 1000 is part of a hook and pile fastener paid, and the liner 1000 is also cut to fit snugly within the sock liner receiving area or cavity of the footwear.

Figure 1B:
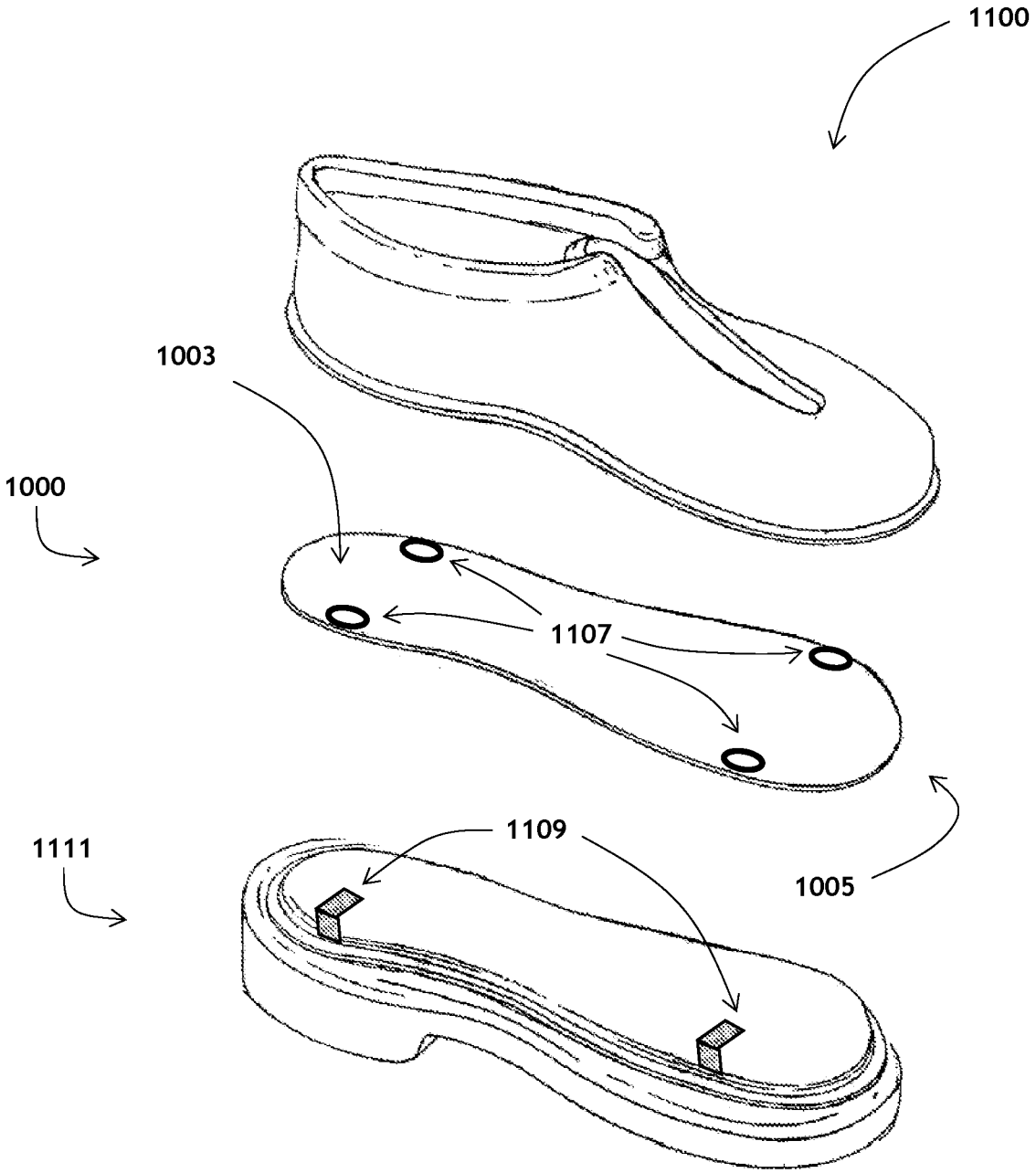
FIG. 1B depicts the liner shown in FIG. 1A with attachments and a shoe in accordance with the invention.

FIG. 1B shows shoe 1100 and sock liner 1000 in accordance with another embodiment of the invention having liner attachments 1107. Liner attachments 1107 may have any number, size, or distribution about the liner 1000. In order to secure liner 1000 within a piece of footwear 1100, liner attachments 1107 must be usable regardless of which side is facing up or down. For example, in one embodiment, liner attachments 1107 are magnetic in order to attach themselves to corresponding metallic portions of the footwear 1100 regardless of the liner's orientation. In another embodiment, liner attachments 1107 are holes, such as grommets or eyelets, in order to receive corresponding nipples protruding within the internal cavity of the footwear. In this embodiment, the nipples are a rubber or soft material that deforms somewhat under pressure in order to avoid applying undesirable force to the user's foot. In yet another embodiment, liner attachments 1107 are thinner portions of liner 1000 that are received within a corresponding nook or strap contained within the cavity of the footwear 1100. Similar to the grommet and nipple embodiment, the nooks or straps in this embodiment are a rubber or soft material that deform under pressure to avoid applying undesirable force to the foot of the user.

In a further embodiment, straps 1109 depicted in FIG. 1B are shown connected to base 1111. Straps 1109 fasten to liner attachments 1107 in order to secure liner 1000 to the liner receiving area or cavity of the shoe. In this embodiment, straps 1109 are part of a hook and loop fastener that interacts with the other part of hook and loop fastener contained on liner attachments 1107. In other embodiment straps 1109 are a chemical adhesive, magnetic, or another fastening mechanism. Although straps 1109 appear on only one side of the base 1111, it will be appreciated that straps 1109 are installed on both sides of the base 1111 to provide a secure attachment to the liner 1000. In another embodiment, straps 1109 are elastic straps that laterally traverse the entire base and connect to both sides of the base, with liner 1000 slipping under the elastic straps 1109 and being secured tightly to the base by the straps 1109. In this embodiment, where elastic straps 1109 laterally traverse the entire base, liner attachments 1107 are not needed.

Figure 1C:
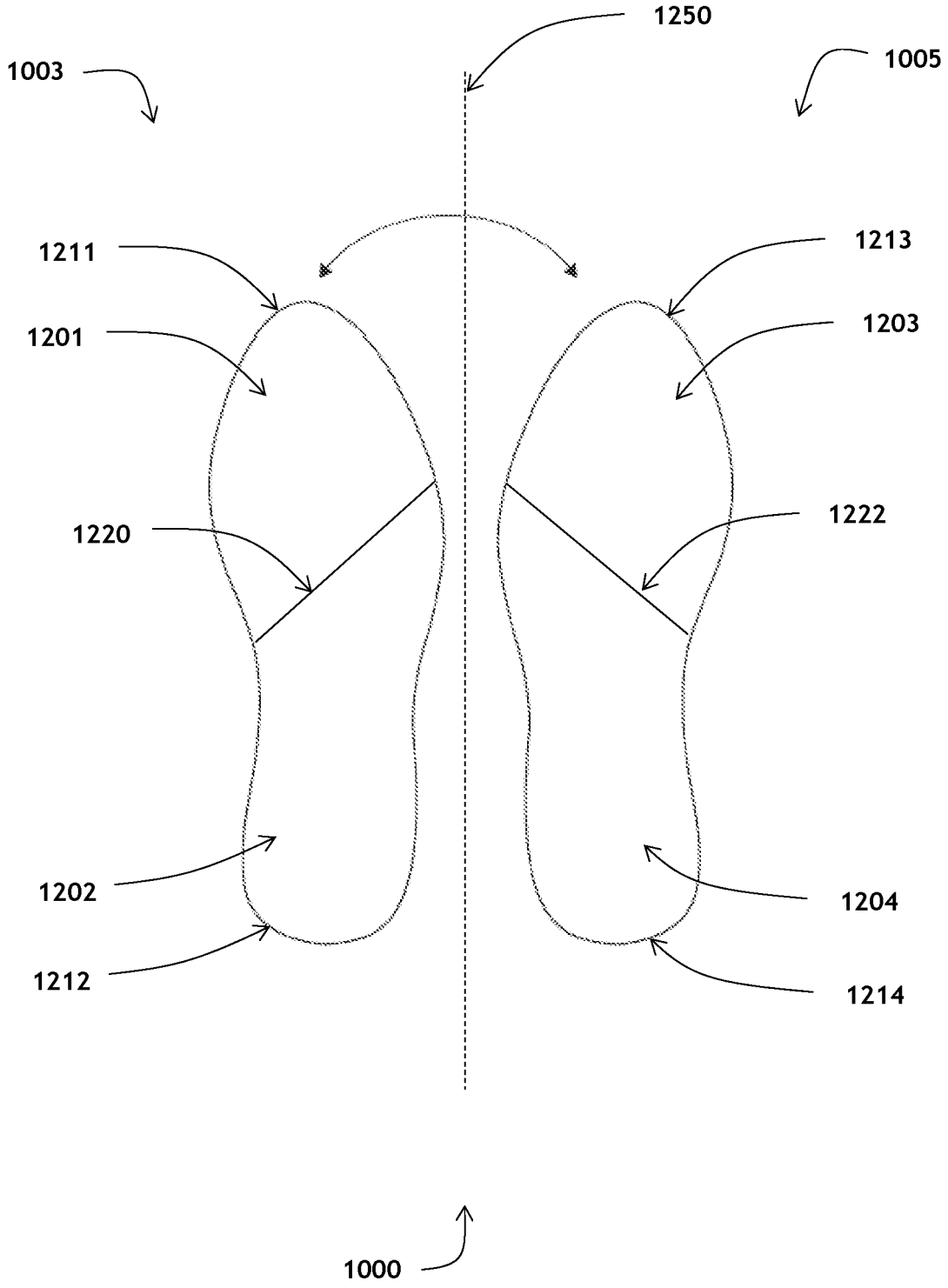
FIG. 1C depicts the liner shown in FIG. 1A with a non-symmetrical shape that is to be used with the opposite foot when flipped or reversed.

FIG. 1C shows a reversible multi-purpose liner having multiple benefits per side, in accordance with another embodiment of the invention. Similar to the embodiment shown in FIG. 1A, liner 1000 is provided with top side 1003 and bottom side 1005. In this embodiment, liner 1000 has a total of 4 benefits, provided as top toe benefit 1201 on top toe portion 1211, top heel benefit 1202 on top heel portion 1212, bottom toe benefit 1203 on bottom toe portion 1213, and bottom heel benefit 1204 on bottom heel portion 1214. It will be appreciated that this embodiment has a total of 4 benefits, with 2 benefits per side. To provide the 4 benefits, liner 1000 is bifurcated into heel and toe portions, in addition to top and bottom sides, as shown. In various embodiments, the benefits provided include: a material composition comprising a non-woven fiber with a hardness of approximately 0-35 measured on the Shore Durometer Scale O, a material composition comprising an elastic polymer with a hardness of approximately 36-70 measured on the Shore Durometer Scale O, a material composition comprising a glycerin or gel-type material, a material composition comprising a bactericide, a surface geography comprising ridges or grooves, a surface geography comprising embroidered patterns, a surface geography comprising raised or indented shapes, a moisture wicking or moisture absorbing property, an odor reducing property, a massaging property or posture correcting property, and a temperature modulating property or traction modulating property, among other benefits.

In one embodiment, top toe portion 1211 provides an odor eliminating benefit, bottom toe portion 1201 provides a temperature modulating benefit, top heel portion 1212 provides a shock absorbing benefit, and bottom heel portion 1214 provides an orthotic benefit. In various embodiments, top toe benefit 1201, top heel benefit 1202, bottom toe benefit 1203, and bottom heel benefit 1204 are any combination of the aforementioned benefits or other benefits. It is envisioned that any number of combinations of benefits may be provided according to the needs of the user. In other embodiments, it will also be readily apparent that identical benefits are used on different portions of the liner 1000 to arrive at a combination of less than 4 total benefits. In one embodiment, given the ten aforementioned benefits and the aforementioned 4 portions, which include top toe portion 1211, top heel portion 1212, bottom toe portion 1213, and bottom heel portion 1214, then the total number of possible combinations is given as $10^4$=10,000.

As in previous embodiments, this reversible sock liner can be flipped about an axis running longitudinally from the heel to the toe, such that the bottom side of the liner now becomes the top side of the liner, and the top side of the liner becomes the bottom side of the liner. Such a construction allows the reversible liner to accommodate a completely different set of attributes on its opposite side, as mentioned above and as will be further discussed below. Since the liner in this embodiment is asymmetrical, the reversible side of the sock liner is to be used with the opposite foot. Likewise, the reversible side of the opposite sock liner is to be used with the present foot. In this way, an entire dual-set of sock liner sides is provided from a single set of sock liners, by allowing the user to flip both sock liners and use them with the opposite foot. In other embodiments, differentiating characteristics between opposite sides of the liners include cushioning, topographical pattern, type or presence of anti-microbial or anti-odor compounds, or color.

In another embodiment, a differentiating characteristic between opposite sides of the liners includes electronic interface components such as those commonly found in Personal Area Networks (PANs) for health or other monitoring devices. Benefits envisioned for such differentiating interface components include tracking statistics for different users of the shoe by simply flipping the insoles, or tracking statistics for the same user for different activities by simply flipping the insoles. For example, the electronic insole could report that a user of the insole took a certain amount of steps in a running configuration, and a separate amount of steps in a basketball or agility configuration.

In another embodiment, arch supports are omitted from the liner 1000. This allows the liner to be flipped without the stiff arch support becoming improperly contoured on the opposite foot. In this embodiment it is envisioned that the arch support will be provided by the sole of the shoe to which the insert is applied. In an alternative embodiment, the arch support is contained within the liner; however, the arch support is made of a more flexible or gel-like material to allow it to be contoured to the opposite foot. In yet another embodiment, the liner is provided with a crease or transition where the body of the liner meets the arch support in order to allow the arch support to more easily bend towards the opposite side of the liner when it is flipped. While the embodiment depicted in FIG. 1C shows abutting seams 1220 and 1222 between top toe portion 1211 and top heel portion 1212, and bottom toe portion 1213 and bottom heel portion 1214, that extend from a lower inner edge near the heel to an upper outer edge near the toe, it will be appreciated that other configurations are possible without departing from the spirit and scope of the invention. For example, the embodiment shown, abutting seems 1220 and 1222 form a generally 45 degree angle with a longitudinal axis 1250 that runs in a direction from the heel to the toe of the liner. In another embodiment the abutting seems 1220 and 1222 form a generally 90 degree angle with longitudinal axis 1250. In other embodiments, abutting seems 1220 and 1222 form 15, 30, 60, 75, 105, 120, 135, 150, 165, and 180 degree angles with longitudinal axis 1250. In one embodiment abutting seems 1220 and 1222 form the same angle with longitudinal axis 1250. In another embodiment abutting seems 1220 and 1222 form different angles with longitudinal axis 1250. It will be appreciated that various configurations of abutting lines 1220 and 1222 are possible without departing from the spirit and scope of the invention.

Figure 1D:
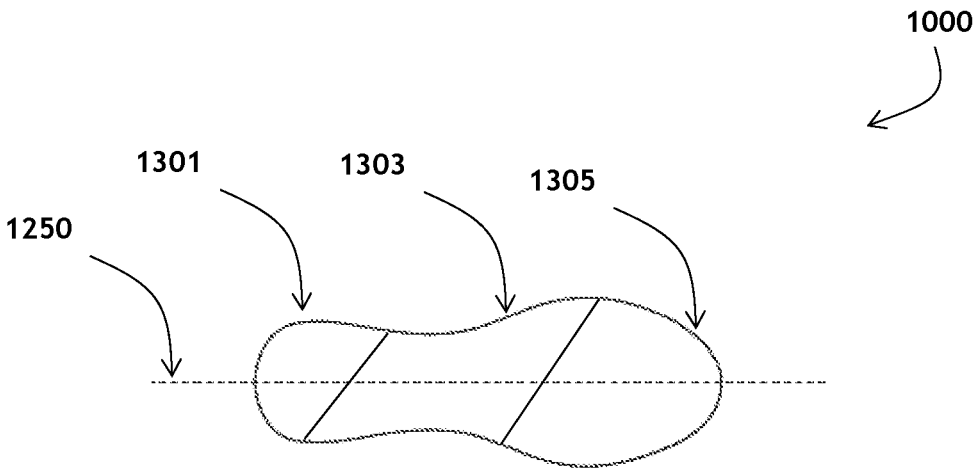
FIG. 1D depicts the liner shown in FIG. 1A with a shape that is symmetrical about a single axis running from the heel to the toe, such that flipping or reversing the liner allows it to be used on the same foot.

FIG. 1D shows another embodiment in which an insole is provided with a shape that is symmetrical about a longitudinal axis 1250 running from a heel of the insole to a toe of the insole. As with the insole provided in FIG. 1C, the present insole may be flipped about the longitudinal axis 1250; however, a benefit of the present insole is that it may be used on the same foot, after having been flipped.

Also shown are a total of 3 benefit areas on a single side of the liner 1000, depicted as areas 1301, 1303, and 1305. In this embodiment, 3 benefit areas are also provided on the opposite side of the liner 1000. This arrangement allows the sole 1000 to provide a total of 6 benefits by flipping the sole 1000 to its other side. Additionally, the abutting edges of the liner portions providing different benefits are shown at a generally 135 degree angle with respect to the longitudinal axis 1250 running from the heel of the liner to the toe of the liner; however, in another embodiment the abutting edges are provided at a generally 90 degree angle with regards to the longitudinal axis 1250. In other embodiments, the abutting edges are provided at 30, 45, 60, 120, 150, and 180 degree angles with regards to the longitudinal axis 1250. It will be appreciated that any angle or distribution of the benefit areas may be envisioned, according to the needs of the user, without departing from the spirit and scope of the invention.

In one embodiment, in order to provide the symmetrical benefit, the symmetrical insole is fashioned with a cut-out on either side of the insole where the arch would be when worn on its primary or reverse sides. Such omission of the arch support on both sides of the liner allows it to be flipped and used on the same foot without an arch support on an opposite side of the liner disturbing the outside of the foot. In this embodiment, it is envisioned that the arch support is provided by the sole of the shoe to which the insert is applied. In an alternative embodiment, the arch support is contained on both sides of the liner; however, the arch support is made of a more flexible or gel-like material to allow it to contour to the outside of the foot when the liner is flipped. Similar to the missing or bilateral arch support embodiments as previously described in FIG. 1C, in one embodiment a support for the big toe is missing and provided by the shoe, or in another embodiment the support for the big toe is bilateral and made of a flexible or gel-like material in order to contour with the narrower outside portion of the shoe designed for the little toe. As shown in FIG. 1D, the toe-end tapers to a symmetrical point in order to allow it to be easily flipped and used with the same foot.

Figure 1E:
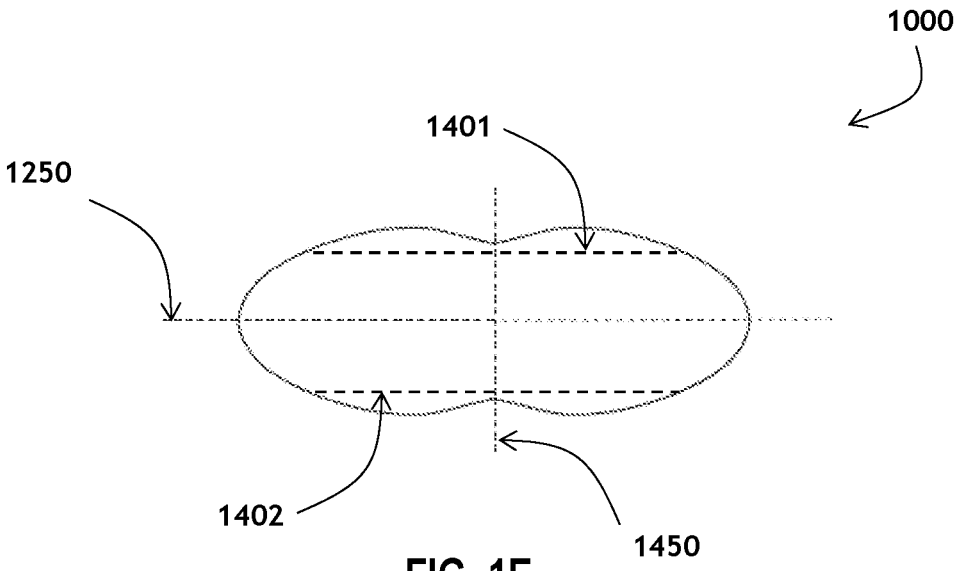
FIG. 1E depicts the liner shown in FIG. 1A with a shape that is symmetrical about 2 axes, such that flipping or reversing the liner about either a longitudinal or a lateral axis allows the liner to be used with either foot irrespective of heel or toe orientation.

FIG. 1E shows a liner in accordance with another embodiment of the present invention, which has a design that is symmetrical about both a longitudinal axis 1250 and a lateral axis 1450. In one embodiment lateral axis 1450 is a transverse axis. Such a construction allows the insert to be flipped about either the longitudinal axis 1250 or the lateral axis 1450 and used with both feet irrespective of heel-to-toe orientation. A benefit of this embodiment is that the liner 1000 can have attributes that vary from a heel end to a toe end of the liner; therefore, it may be turned or rotated in order to reverse the correspondence of the attributes from the heel to the toe of the user. An advantage of this embodiment is that multiple benefits may be enjoyed by the user without flipping the liner to the opposite side. In some embodiments, liner 1000 has first configuration stripe 1401 and second configuration stripe 1402. In some embodiments first configuration stripe 1401 and second configuration stripe 1402 are creases, stitches, seems, or perforations for altering a profile of liner 1000. In some embodiments, liner 1000 is more easily made to fit inside the footwear upon the user's modulation of the creases, stitches, seems, or perforations of the first configuration stripe 1401 and the second configuration stripe 1402. In some embodiments first configuration stripe 1401 and second configuration stripe 1402 entail the bending or removal of material by the user in order to accomplish arriving at an altered profile of the liner 1000.

Figure 1F:
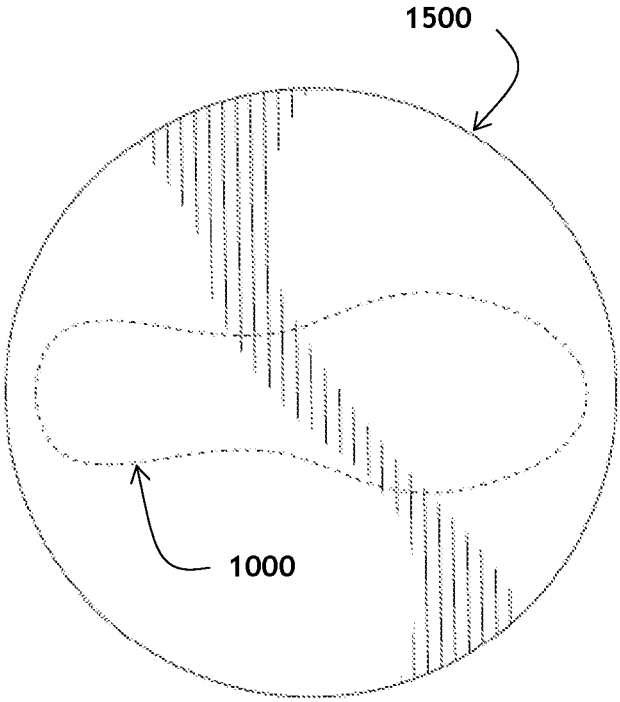
FIG. 1F depicts the liner shown in FIG. 1A with a broken-line outline of the liner, which is overlaid on a material blank from which the liner is to be cut-out.

FIG. 1F shows a material blank 1500 enclosing an outline of a liner 1000 in accordance with another embodiment of the invention. In this embodiment, it is envisioned that a customer is provided with a full-sized material blank 1500 having a uniform or varying set of attributes across one or both of its surfaces, and from the material blank the customer may cut the shape of a liner 1000 having a distribution of attributes of their choice. In this manner, the customer may favor certain attributes towards a heel of the insole and different attributes towards a toe of the insole. In another embodiment, the customer may favor different sets of attributes between the insides and outsides of their feet, and likewise may cut the liner to have a desirable side-to-side distribution of attributes. Although a liner that is symmetrical about a longitudinal axis is shown, as in FIG. 1D, another embodiment uses a liner that is asymmetrical about a longitudinal axis, as in FIG. 1C. It will be appreciated that any of the liners described herein may be used with the material blank 1500 without departing from the spirit and scope of the invention.

Figure 1G:
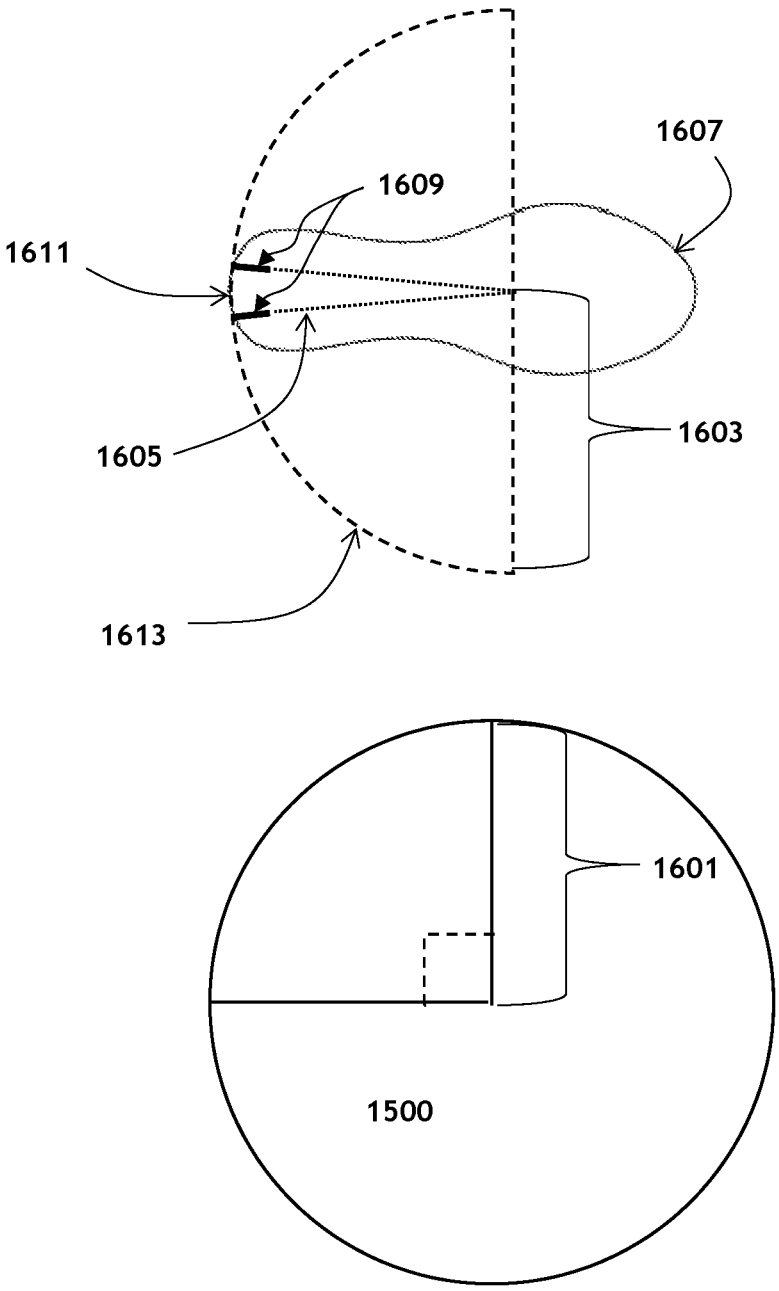
FIG. 1G depicts the liner shown in FIG. 1A as a template along with a material blank, and demonstrates that the radii of the liner heel and material blank are identical.

FIG. 1G provides an embodiment of the invention in which a material blank 1500 is provided along with a template 1607 having a heel for easy indexing. Material blank 1500 is provided to the customer in the shape of a circle having a radius r1 1601 that is identical to a radius r2 1603 of an arc 1611 that constitutes a portion the heel of the liner template 1607. The arc 1611 passes through at least a minimum angle 1605 of an imaginary circle 1613 defined by radius r2 1603. An angle of about 10 degrees is shown; however, in other embodiments the angle is greater or lesser than 10 degrees without departing from the spirit and scope of the invention. For example, in one embodiment the angle 1605 is at least 5 degrees, and in another embodiment the angle 1605 is at least 15 degrees. In this way, the customer aligns the heel of template 1607 exactly coincident with the edge of the material blank 1500, and the resulting outline will have a heel that is perfectly matched to their footwear. In cutting out the outline of the insert, the customer need only trim the excess material around the sides and toe of the outline, as the heel is already correctly sized. In this embodiment, the customer is given one or more material blanks 1500 along with one or more templates 1607. By indexing the heels of templates 1607 to the edge of blanks 1500, the customer can rotate the templates 1607 about the blanks 1500 until the desired distribution of attributes is achieved, and then cut out a liner 1000 having a profile or silhouette matching that of template 1607. In one embodiment guidelines 1609 are provided on the template 1607 to indicate how much of the heel the customer should use for indexing. In another embodiment, the size of the angle 1605 through which arc 1611 and corresponding radius r2 1603 is identical to the circle of material blank 1500, as defined by radius r1 1601, is customized according to the specific footwear with which the customer intends to use the liner 1000. Alternatively, in another embodiment, the angle 1605 is sized according to what is most compatible with the intended footwear for a given type of material blank 1500. For example, in one embodiment material blanks 1500 having attributes catered towards athletic applications have a smaller angle 1605, and material blanks 1500 having attributes catered towards formal applications have a larger angle 1605. Although a liner that is symmetrical about a longitudinal axis is shown, as in FIG. 1D, another embodiment uses a liner that is asymmetrical about a longitudinal axis, as in FIG. 1C. It will be appreciated that any of the liners described herein may be used with the heel made for easy indexing.

Figure 1H:
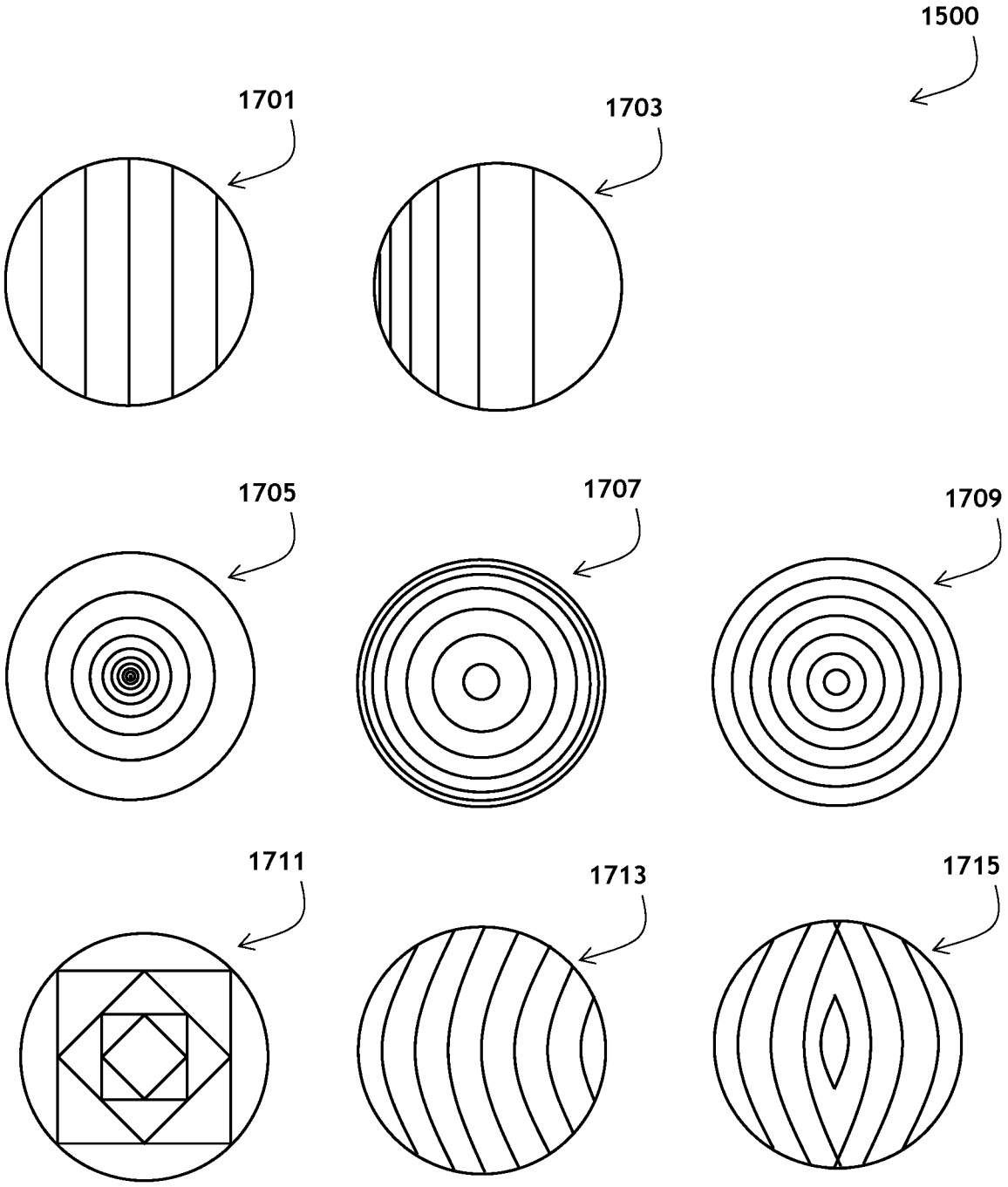
FIG. 1H depicts a plurality of material blanks having varying material compositions or patterns overlaid with an outline of the liner shown in FIG. 1A.

FIG. 1H shows an embodiment of the invention wherein one or multiple material blanks 1500 are provided to the customer with one or a variety of different topographies of attributes. For example, in one embodiment a material blank 1500 is provided with a gradient of surface cushioning, such that one portion of the blank provides more cushion than another. Alternatively, in another embodiment a material blank 1500 is provided with a greater amount of friction, anti-odor treatment, sweat-wicking, or any other property from one part of the material blank to the next. A variety of gradients and topographies of surface attributes are envisioned, and the depicted gradients are shown for exemplary purposes only. Referring to the topographies shown in FIG. 1H, topography 1701 provides equidistant and parallel abutting seems that run longitudinal between attribute areas. Topography 1703 provides non-equidistant and parallel abutting seems that run longitudinal between attribute areas and that progress from a tight grouping to a loose grouping. Such a topography allows the customer to configure increasing or decreasing amounts of one or more attributes across their desired liner 1000. Topography 1709 provides abutting seems in equidistant concentric circles that separate attribute areas. Topography 1705 provides abutting seems in non-equidistant concentric circles that separate attribute areas, where the non-equidistant concentric circles progress from a tighter grouping in the center to a looser grouping at the edge of the material blank 1500. Topography 1707 provides abutting seems in non-equidistant concentric circles that separate attribute areas, where the non-equidistant concentric circles progress from a looser grouping in the center to a tighter grouping at the edge of the material blank 1500. Topography 1711 provides abutting seems defined by offset squares of increasing size from the center to the edge of the material blank 1500. Topography 1713 provides abutting seems in parallel, chevron-shaped lines that separate attribute areas. Topography 1715 provides abutting seems in two sets of opposite-facing, parallel, chevron-shaped lines that meet in the middle of the material blank and that separate attribute areas. In other embodiments, topographies besides those shown in FIG. 1H are implemented. It will be appreciated that any topography of abutting lines may be used without departing from the spirit and scope of the invention.

Figure 2A:
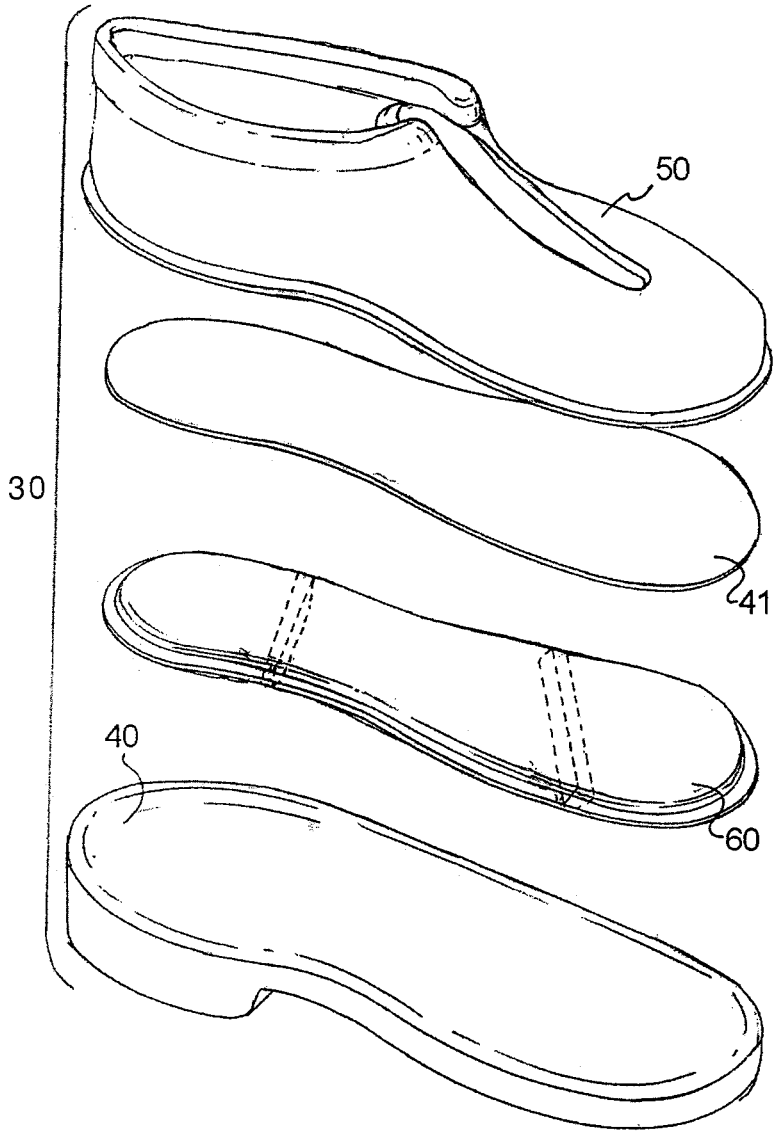
FIG. 2A depicts the liner shown in FIG. 1A within a shoe in accordance one embodiment of the invention.
Figure 2B:
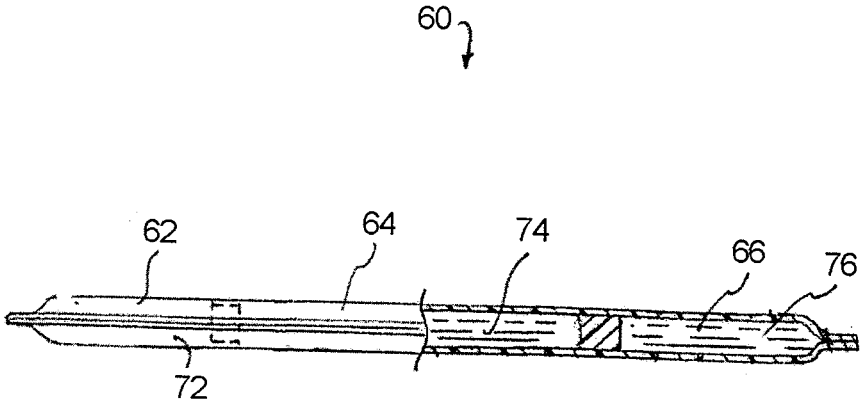
FIG. 2B more particularly depicts the bladder shown in FIG. 2A, which comprises the liner shown in FIG. 1A in accordance one embodiment of the invention.

FIG. 2A depicts shoe 30 for use with liner 1000 in accordance with an embodiment the invention. Shoe 30 includes outsole 40, upper 50, and bladder 60, placed between outsole 40 and upper 60 for cushioning and/or supporting a user's foot. For enhanced comfort, auxiliary sockling 41 is optionally placed on top of bladder 60 for receiving a user's foot. In reference to FIGS. 2-10 below, in one embodiment bladder 60 comprises the reversible liner 1000. In another embodiment auxiliary sockling 41 comprises the reversible liner 1000. In yet another embodiment both the bladder 60 and the auxiliary sockling 41 together comprise the reversible liner 1000. As more particularly depicted in FIG. 2B, bladder 60 includes at least one chamber for containing a filler. As shown, bladder 60 includes first chamber 62, first filler 72, second chamber 64, second filler 74, third chamber 66, and third filler 76.

It is understood that although 3 chambers are shown, in other embodiments bladder 60 includes any number of chambers or a plurality of chambers, as well as a filler for each chamber including a plurality of fillers. The more chambers, the more bladder 60 may be filled with differing fillers of differing softness, density, or comfort in various areas of bladder 60. It is understood that the shape of a chamber is not germane to the invention.

In some embodiments, bladder 60 is removably placed between outsole 40 and upper 50 so that other bladders of varying characteristics may be utilized. This is advantageous when shoe 30 is used for different sports or in different environments and bladder 60 may be interchanged with another bladder rather than altering bladder 60. This reduces time especially if the process is to be repeated. In further embodiments, bladder 60 is integrally placed between outsole 40 and upper 50. This reduces the likelihood of bladder 60 from becoming accidentally dislodged.

For purposes of simplicity, first filler 72 will be described but it should be known that second filler 74, third filler 76, and a plurality of fillers all include the same limitations as first filler 72. Likewise, although first chamber 62 is described in detail below, it is understood that second chamber 74, third chamber 76, and a plurality of chambers all include the same limitations as first chamber 62. Moreover, although each filler is capable of being different than a next filler, it is not required. In some embodiments, two fillers are the same but a third filler is different. In other embodiments, all three fillers are different.

In one embodiment, first filler 72 is any solid, powder, liquid, or gas that is placed within first chamber 62. The purpose of first filler 72 is to vary support, cushioning, and/or comfort to the wearer's foot depending upon the wearer's preferences. Hence, in various embodiments, a density, volume, weight, texture, consistency, and any other property of the filler is varied or user determined in any combination. For example, if a particular liquid does not provide adequate support, a different liquid is utilized, where the second liquid has a different density, buoyancy, texture, or weight. Therefore, when compressed by the foot, the wearer will experience the particular sensation, support, cushioning, or comfort unique to the particular filler. When a filler is defined to be different than a next filler, it means any of the properties or characteristics, or a combination for the properties or characteristics, listed herein is varied or changed.

In one embodiment, in instances where filler 72 is of a low viscosity, such as with some liquids, or where filler 72 is easily compressed, such as with some gases, first chamber 62 is depressed to the point where there is no filler 72 in one part of first chamber 62, in which case in one embodiment little or no cushioning, support, or comfort is derived from first filler 72. In one embodiment this is due to compression of first chamber 62 from walking or running by a wearer.

Figure 3:
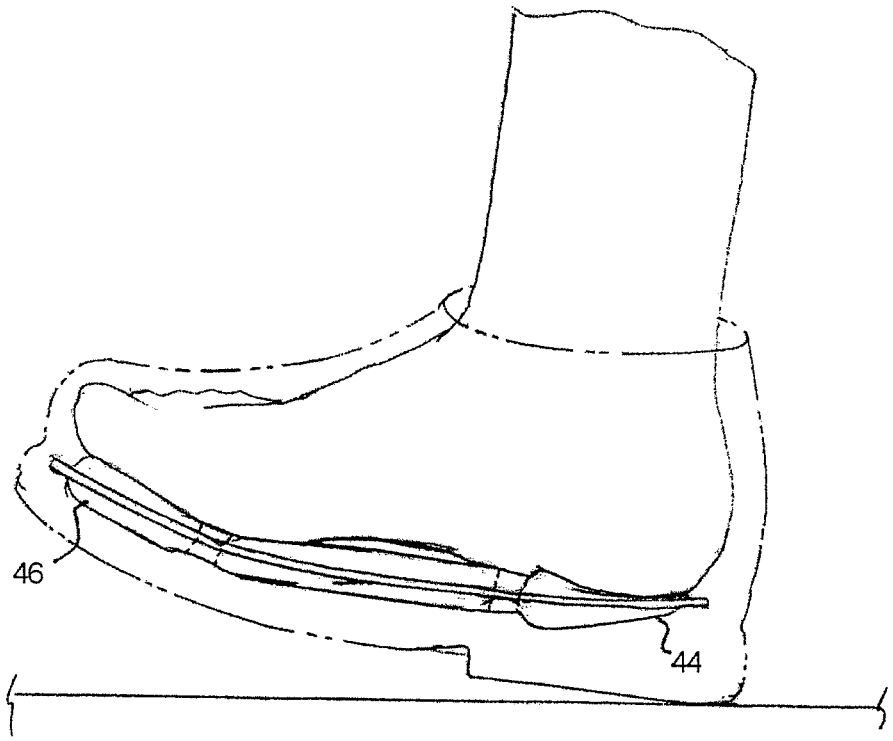
FIG. 3 depicts the bladder of FIG. 2A, which comprises the liner shown in FIG. 1A being compressed during usage in accordance one embodiment of the invention.

During walking, the wearer typically strikes the heel first and then rolls to the middle of the foot and finally to the balls or toes of the foot. In one embodiment, during this rolling, or gradual transition, from heel to toe, a chamber is compressed on first part 44 and not second part 46, and vice versa (as shown in FIG. 3). This problem is exacerbated if first filler 72 is compressible or has a low viscosity.

Figure 4A:
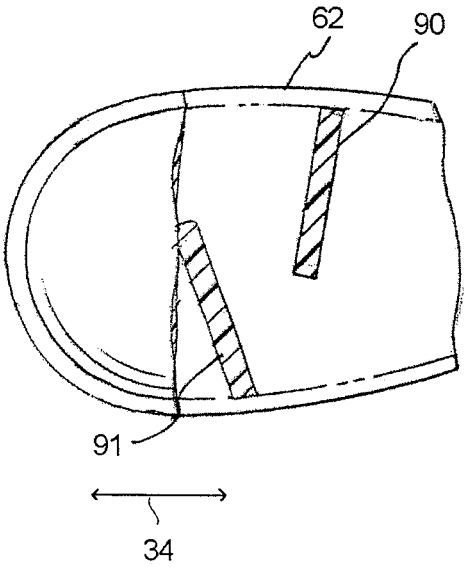
FIGS. 4*a* and 4*b* shows the inside of the bladder shown in FIG. 2A, which comprises the liner shown in FIG. 1A in accordance one embodiment of the invention.
Figure 4B:
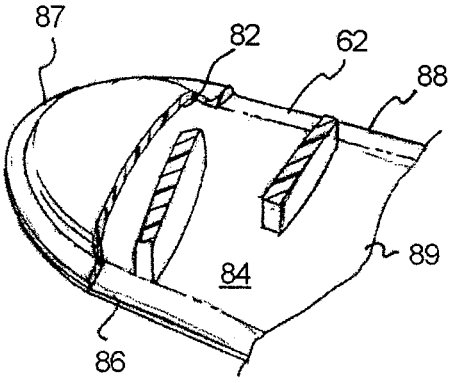

As shown in FIG. 4*a*, baffle 90 is any structure placed within any chamber for inhibiting movement of a filler. Baffle 90 is optional. In some embodiments, baffle 90 is placed in some chambers but not other chambers. For purposes of simplicity, baffle 90 will be described as shown within first chamber 62. However, in other embodiments, other chambers is include baffle 90. In some embodiments, baffle 90 is a wall connected to roof 82 and floor 84 of first chamber 62. In one embodiment baffle 90 is angularly attached to roof 82 and floor 84 or attached to roof 82 and floor 84 at right angles, depending upon the resistance desired for inhibiting movement of the filler. In other embodiments, baffle 80 is attached to either roof 82 or floor 84 but not both. In simpler embodiments, baffler 80 is merely a contact point between roof 82 and floor 84 without any walls or structure to connect roof 82 with floor 84, which in one embodiment is ineffective if the walls or structures become dislodged. In this fashion, melting or cementing roof 82 to floor 84 is less costly and easier to achieve the purpose of inhibiting movement of a filler than connecting a wall to roof 82 and floor 84. Moreover, melting or cementing roof 82 and floor 84 together to form baffle 90 can be done in the same operation as forming a chamber, which connects or seals a periphery of roof 82 and floor 84 together.

It is understood that in one embodiment baffle 90 extends partially across first chamber 62 from left side 86 to right side 88 or front side 87 to back side 89; however, in another embodiment baffle 90 extends entirely across first chamber 62 from left side 86 to right side 88 or front side 87 to back side 89. Additionally, in one embodiment baffle 90 is placed at an angle relative to the longitudinal axis of shoe 34, as shown more clearly in FIG. 4*b* (a top view of chamber 62 and baffle 90). In order to vary the resistance to filler for inhibiting the movement of filler, in one embodiment the angle of baffle 90 relative to the longitudinal axis is varied to inhibit more or less of the filler's movement. Moreover, in one embodiment baffle 90 is placed at a different angle than a next baffle 91. Similarly, in one embodiment baffle 90 is attached to top sheet 82 and bottom sheet 84, but in yet another embodiment baffle 91 is attached only to bottom sheet 84. Also, in another embodiment the angle at which baffle is attached to roof 82 varies from that of baffle 91. Still further, in another baffle 90 extends at different lengths across chamber 62 than next baffle 91, whether it be from left side 86 to right side 88 and/or from front side 87 to back side 89.

In some embodiments of the invention, and in addition to or instead of the above description for baffle 90, baffle 90 includes permeable membrane 93. Membrane 93 is any thin, pliable sheet that acts like a filter that permits filler 72 to pass through but controls or slows the flow of filler 72, which results in a controlled or slowed depression, or compression, of bladder 60 when a user's foot presses down upon bladder 60. In some embodiments, permeable membrane 93 permits parts of filler 72, such as molecules containing Carbon, to pass through but inhibits other parts of filler 72, such as molecules not containing Carbon, from passing through. This feature would act as, in addition to the presence of membrane 93 itself, another control to slow the flow of filler 72. FIGS. 5*a*-5*d* depict various applications of permeable membrane 93 in first chamber 62.

In this fashion, in various embodiments, bladder 60 is customized in a variety of different ways depending on what change or combination of changes are made to the properties of the filler. For example, besides changing the filler, in other embodiments, a volume of the filler is increased to enhance comfort. In other embodiments the filler is a gel or solid to increase support or act as an orthotic. Moreover, the more chambers in bladder 60, the more adjustments that can be made since each chamber can have a different filler with a different volume, density, or feel. Various types of materials for use as a filler include visco elastic or memory foam to mold to the shape of the user's foot, open and closed cell polyurethane foams, water, oil, helium, polyurethane gel, acrylic polymer gel, and the like. Additionally, baffle 90 further customizes bladder 60 by permitting flow control of filler 72, depending upon the orientation or material of baffle 90 and/or next baffle 91.

Figure 5A:
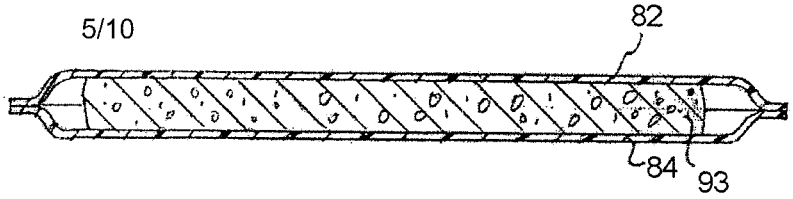
FIGS. 5*a*-5*d* show various applications of a baffle placed within the bladder of FIG. 2A, which comprises the liner shown in FIG. 1A in accordance one embodiment of the invention.
Figure 5B:
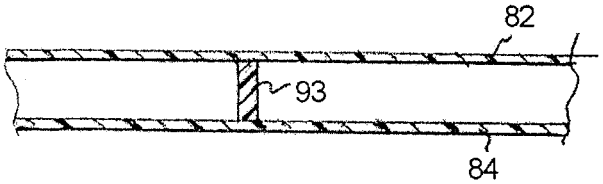
Figure 5C:
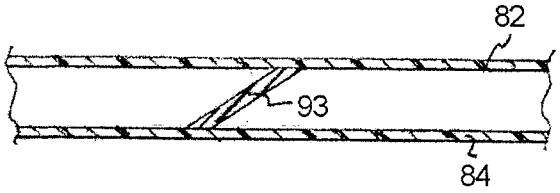
Figure 5D:
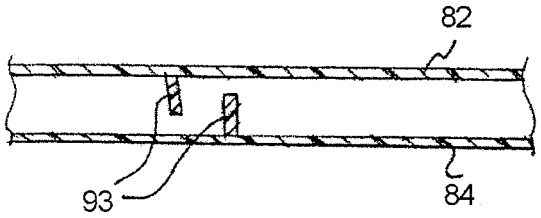

As shown, bladder 60 extends from toe area 36 to heel area 38 of shoe 30 and from left side 37 to right side 39 of shoe 30. Also as shown, membrane 93 extends from toe area 36 to heel area 38 and from left side 37 to right side 39. In some embodiments, bladder 60 extends partially across shoe 30. Also, as shown in FIGS. 5B-5D, membrane 93 extends partially across shoe 30 too.

It is understood that, in one embodiment all chambers re made of the same material and are the same size. In other embodiments, each chamber is of a different material than a next chamber. In further embodiments, each chamber is of a different size than a next chamber.

For example, in one embodiment, first chamber 62 is made of rubber while second chamber 64 is made of a more resilient or elastic material. In some embodiments different materials are needed to accommodate different fillers. If first filler 72 is a liquid, first chamber 62 would be of a material strong enough to reduce rupture while also being leak resistant. Hence, in on embodiment rubber is utilized. In some embodiments If second filler 74 is a gel, second chamber 62 does not necessitate a material that is particularly leak resistant if flexibility is more desired. Hence, in one embodiment a stretchable material such as cloth or spandex is utilized to contain a gel. Perhaps a canvas type material is desired due to its strength rather that its leak resistance. Therefore, depending upon the type of filler and desired function of the chamber, in some embodiments the material for each chamber is varied, and in other embodiments the material for each chamber is the same as the next chamber.

In some embodiments the material of a chamber is selected depending upon any desired or undesired chemical reaction between the filler and the chamber. For example, in one embodiment if a filler contains hydrogen, the material selected for the chamber is desired to be free from reaction with hydrogen. In other embodiments, the material is desired to react with hydrogen so that, for example, water is formed and acts as a lubricant.

By having at least one chamber (first chamber 62, second chamber 64, and third chamber 66) in a side by side orientation as shown (see FIG. 2B), bladder 60 improves comfort and provides continuous cushioning as bladder 60 transitions from chamber to chamber. This is because the chambers are in such close proximity to one another, and fixed in such positions since all chambers are fixedly attached together to form bladder 60, that the cushioning in bladder 60 feels continuous to a wearer.

Moreover, in some embodiments each chamber is filled with a different filler than a next chamber so that areas of bladder 60 that are subjected to higher stress conditions. For example in some embodiments the heel is filled with a filler of higher resistance to compression and areas subjected to lower stress, such as the arch, are filled with a filler of higher flexibility. By using different fillers in different chambers, bladder 60 provides flexibility in select areas and strength/stability in other areas.

Further, due to baffle 90, in some embodiments a chamber is less likely to bottom out since the filler will be impeded from moving completely from one area of the chamber to another area of the chamber. In this fashion, baffle 90 helps prevent the chamber from bottoming out since there will be filler in all areas of the chamber, particularly in areas being subjected to stress.

In some embodiments the types of fillers that are employed are all selected by a user, which is the wearer in some embodiments and a manufacturer of bladder 60 in the other embodiments. The user selects a particular filler based on the filler's physical properties and the type of cushioning, strength, or rigidity desired as well as the projected environment in which shoe 30 is used.

As stated above, the filler is selected depending upon a variety of properties or characteristics of the filler. Below is table of the various properties of each filler. All properties are understood to be approximate.

| | Gel | Foam | Water | Polyurethane Gel | Oil |
|---|---|---|---|---|---|
| Density $(g/cm)^3$ | .35-.65 | .20-.45 | .96 | .50-.75 | .85-1.00 |
| Viscosity (cps) | 600-800 | n/a | .89 | 800-1,200 | 400-600 |
| Shore 00 Durometer | 40-50 | 30-40 | n/a | 50-70 | n/a |
| Weight of Use (lbs) | ≥200 | ≥125 | ≥100 | ≥150 | ≥135 |

Figure 6A:
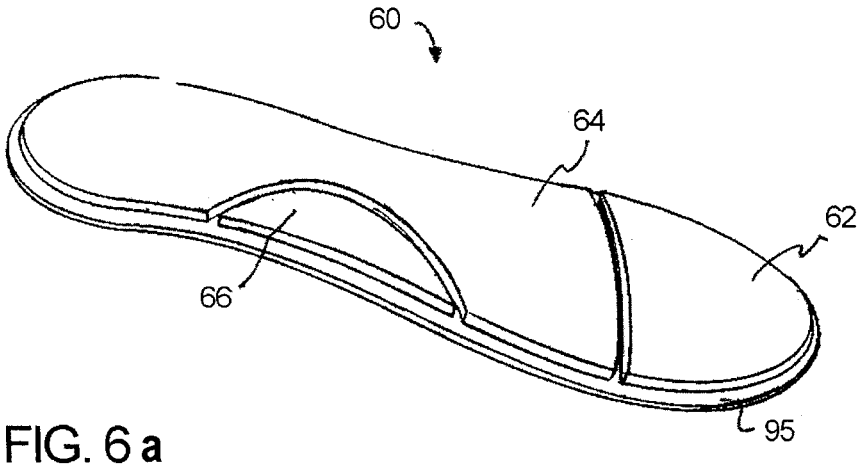
FIG. 6*a*-6*c* depicts another embodiment of the bladder shown in FIG. 2A, which comprises the liner shown in FIG. 1A in accordance one embodiment of the invention.
Figure 6B:
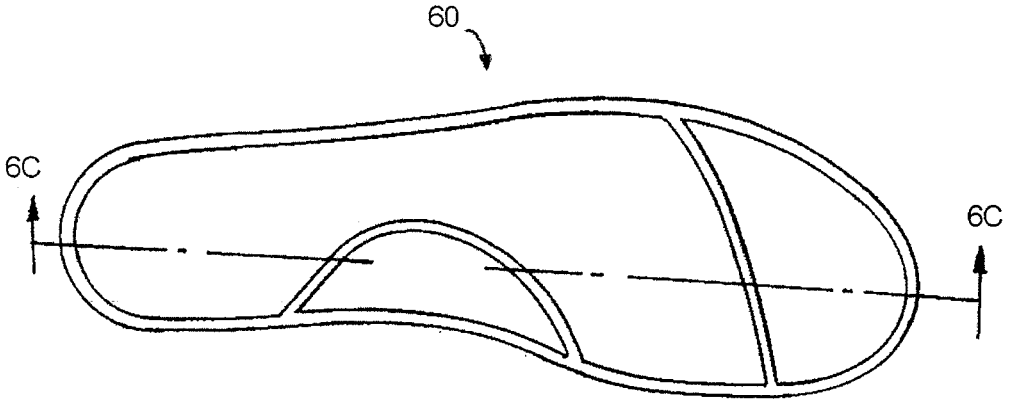
Figure 6C:
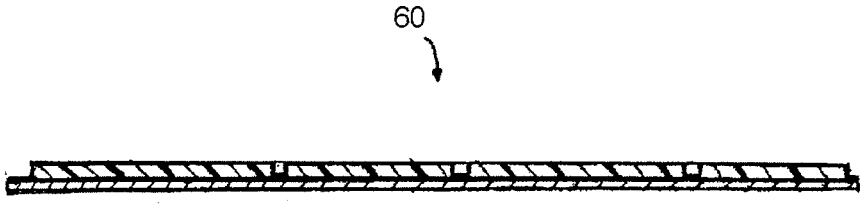

FIGS. 6*a*-6*c* depict another embodiment of bladder 60 where wicking fabric 95 is secured to a top of surface of bladder 60. As shown, wicking fabric 95 is integrally attached to first chamber 62, second chamber 64, and third chamber 66 and where first chamber 62, second chamber 64, and third chamber 66 are separate from one another, although the spacing between the chambers resembles that of bladder 60 shown in FIG. 2A. In the embodiment shown in FIGS. 6*a*-6*c*, wicking fabric 95 is adhered across the top of bladder 60 and effectively connects first chamber 62, second chamber 64, and third chamber 66 together. In this fashion, it would be redundant to further connect first chamber 62, second chamber 64, and third chamber 66 together as shown in FIG. 2A and then adhere wicking fabric 95 onto bladder 60. However, although first chamber 62, second chamber 64, and third chamber 66 shown in FIGS. 6*a*-6*c* are initially separate from one another, all three chambers achieve the same advantages of the embodiment shown in FIG. 2A when all are attached to wicking fabric 95. In some embodiments first chamber 62, second chamber 64, and third chamber 66 are each independently attached to wicking fabric 95.

As shown, first chamber 62, second chamber 64, and third chamber 66 are all made of a solid gel or foam, such as a visco elastic memory foam, where the filler for each chamber and the chamber itself form a single unit. In other words, first chamber 62, second chamber 64, and third chamber 66 do not require a respective filler and, vice versa, the first, second, and third fillers do not require a respective chamber to contain each filler. This embodiment simplifies the invention by combining each filler together with each respective chamber.

Wicking fabric 95 is any material used to absorb moisture and/or odor away from the user's foot. In one embodiment wicking fabric 95 further includes a bacteria reducing agent and/or fragrance emitting agent to reduce fungus and help the foot smell better.

In some embodiments, wicking fabric 95 is a two-layered composite having a cover layer and a foam layer that is hydrophilic with respect to the cover layer, which is operatively joined or connected or bonded or otherwise laminated in any suitable way to the cover layer as by needle punching, so that the composite material acts to draw or transfer moisture or bodily fluids from and through the cover layer into the foam layer which acts as a reservoir, to absorb, gel or store and dissipate such moisture or bodily fluid as by evaporation from or by washing of the composite material. After the moisture or bodily fluid is dissipated, from time to time, the composite material can be reused. However, those skilled in the art will recognize that the composite materials formed in accordance with the present invention can also be made of materials so that the composite material can also be disposable rather than reusable.

In some embodiments the foam layer is first formed by polymerizing an aqueous mixture, having as its principal component one or more sorbents with or without various additives, with a predetermined quantity of a hydrophilic urethane prepolymer binder so that the polymerization of the polyurethane foam forms a matrix binder for the one or more sorbents. While the sorbents have been referred to as the principal component, it will be readily understood by those skilled in the art that in other embodiments the aqueous mixture consists of various combinations of other components without departing from the scope of the present invention including absorptive fillers, fibrous materials, including non-woven fiber materials, surfactants, thermoformable acrylic latex emulsions, odor absorbents and bactericides. In further embodiments, additional components include citric acid, rubber particles and thermal phase change particles depending on certain advantageous and desirable characteristics or functions to be achieved by the composite material.

In some embodiments the characteristics of the sorbent component is selected so that the volume, rate of absorption and the retention or gelling of the moisture absorbed under varying ambient conditions of temperature and pressure are optimized for a given composite material being formed. Preferred sorbents adapted for use in the aqueous mixture are primarily super absorbent polymers available in the commercial marketplace as SAB 800 from STOCKHAUSEN, Greensboro, N.C. 27406; as SANWET 1M 1000 from Hoechst Celanese Corporation, Portsmouth Va. 23703; as ARIDAL 1460 from Chendal Corporation, Palatine, III. 60067; and as ARASORB 800F from Arakawa Chemical Industries, Limited, Osaka 541, Japan.

These sodium polyacrylatejpolyalcohol polymer and copolymer sorbents are manufactured and sold in free-flowing, discrete solid particles, in powder or granular form, and are characterized by the fact that they have a propensity for absorbing increasing quantities of aqueous fluid. This would normally lead to the complete solution of the polymers into the aqueous mixture. However, due to the chemical characteristics of the polymers and co-polymers, the formation of a gel takes place precluding the solution of the polymer or copolymers. In other embodiments other sorbents including polyethylene oxide, sodium carboxymethyl cellulose, and like polymers, desiccants such as silica gel, clays such as bentonite, and the like are used as well.

Thus, when an aqueous mixture is metered and mixed with a hydrophilic urethane prepolymer, as more fully described below, the urethane prepolymer reacts with the water in the aqueous mixture to form a hydrophilic polyurethane foam, and at the same time when a sodium polyacrylate sorbent is present, the urethane prepolymer reacts with the sorbent to form a hydrophilic acrylic urethane interpolymer.

The combination of the sorbent with the hydrophilic foam thus formed acts in composite materials of either two larger or multiple layers to absorb, adsorb and gel the moisture drawn through the cover layer and to contain and store it so as not to rewet the cover top layer of the layered composite material. The sorbents thus add hydrophilicity to the foam layer of the composite materials.

The additives which are combined in the aqueous mixture with the sorbents are also available in the commercial marketplace.

Thermoformable acrylic latex emulsions are available from Union Carbide Corporation of New York, N.Y., Rohm & Haas, B. F. Goodrich and others. One preferred form of acrylic emulsion is available from Union Carbide under the trademark "UCAR 154". As is well known to those or ordinary skill in the art, latex emulsions are surfactant-stabilized polymer emulsions, and are commonly used as binders for non-woven materials. The thermoformable latexes form thermoplastic polymer films that are capable of being formed or molded when the film is heated above the glass transition temperature of the polymer.

Use of acrylic latex emulsions in the foam layer of the present invention thus serves as an alternative to the three-layer composite materials of the present invention wherein the third layer is a thermoformable non-woven material bonded to the side of the foam layer remote from the cover layer. The thermoformable acrylic latex emulsions are incorporated into the foam layer by including the emulsion as part of the aqueous mixture reacted with the hydrophilic urethane prepolymer. The water content of the emulsion reacts with the hydrophilic urethane prepolymer to form the polyurethane foam when the aqueous mixture and the urethane prepolymer are reacted together. Thus, the water content of the emulsion should be included as part of the water content of the aqueous mixture when calculating the ratio of the aqueous mixture to be reacted with the urethane prepolymer. Those of ordinary skill in the art will understand that the acrylate component contributed by the thermoformable acrylic latex emulsion is discrete and separate from the acrylate component contributed by the sodium polyacrylic sorbent, when present.

When the foam polymerization is complete, residual water is driven off by drying the foam at a temperature of about 2000 F. After bonding of the foam layer to cover layer, the thermoformable acrylic latex, when present, permits the forming or molding of the composite by heating the composite in a mold or other form at a temperature above the glass transition temperature of the acrylic latex, typically a temperature of about 2700 F., after which the composite is cooled and removed from the mold or form.

Surfactants useful in the combinations in accordance with the present invention are prepared from non ionic polyethylene and polypropylene oxides such as the BASF surfactant available under the trademark "PLURONIC".

Odor absorption materials are also well known to those skilled in the art and include, activated carbon, green tea, "ABSENT" (UOP); zinc oxide and the like materials.

Bactericides are provided in the commercial marketplace by a myriad of suppliers for controlling bacterial and germ growth. One preferred material is supplied by Lauricidin Co. of Galena, III. 61036, under the trademark "LAURICIDIN".

Phase change materials are capable of absorbing approximately 100 BTU/lb. These materials are described in U.S. Pat. Nos. 4,756,958 and 5,254,380.

In other embodiments other components are added to the aqueous mixtures, such as citric acid as a buffer for reducing the pH of the water component to increase loading of the sorbent and the fluid characteristic of the aqueous mixture to facilitate pumping of the aqueous mixture; and ground rubber particles from tires available from Composite Particles of Allentown, Pa. increase the resiliency and thermal protection of the composite material. These will be illustrated in the examples of the aqueous mixture more fully set forth below.

The hydrophilic urethane prepolymer component is also available in the commercial marketplace. Suitable prepolymers will be readily recognized by those of ordinary skill in the art and are described in U.S. Pat. Nos. 4,137,200; 4,209,605; 3,805,532; 2,993,013 and general procedures for the preparation and formation of such prepolymers can be found in Polyurethane's, Chemistry and Technology by J. H. Saunders and K. C. Frisch published by John Wiley & Sons, New York, N.Y., at Vol. XVI Part 2, High Polymer Series, "Foam Systems", pages 7-26, and "Procedures for the Preparation of Polymers", pages 26 et seq.

One preferred form of such prepolymer adapted for use in the present invention because of its strong hydrophilic characteristics and its reasonable price is marketed by Matrix R&D of Dover, New Hampshire as TDI/PEG Urethane Prepolymer under the trademark "BIPOL". These products are polyether urethane polymers of toluene diisocyanate terminated polyethylene glycol with less than six percent (6%) available unreacted NCO groups and a component functionality of two (2) or less.

Another urethane prepolymer is available from W. R. Grace Company of New York, N.Y. sold under the trademark "HYPOL 3000". This "HYPOL" urethane prepolymer is a polyisocyanate capped polyoxylene polyol prepolymer having a component functionality greater than two (2). However, this prepolymer is formulated with a triol which reduces its hydrophilic capability. Therefore, this "HYPOL" urethane prepolymer is less acceptable for the formation of the base layer of the composite material.

When the hydrophilic urethane prepolymer is added in precise amounts to the aqueous mixture, in addition to controlling the absorption characteristics of the final composite material, it has been found that it enhances the composite material so it can be sized and thermoformed into three dimensional shapes such as the insole for shoes.

Thus, in the formation of the foam layer, a given aqueous mixture will be blended in ratios of 2 to 10 parts by weight of the aqueous mixture to 1 part by weight of the hydrophilic urethane prepolymer. Controlling in precise amounts the relative ratio of the aqueous mixture to the hydrophilic acrylic urethane prepolymer within these limits does not impair the capabilities of the super-absorbent polymer for absorbing and gelling moisture and body fluids with which the composite material comes into contact.

Another form of the composite material in accordance with the present invention in which the cover layer, foam layer hydrophilic with respect to the cover layer and a bottom or third layer is in the form of a non-woven fiber web or felted non-woven fiber web material. In this form of the composite material, the non-woven fibers selected are preferably those having stiffening or thermoforming capabilities.

Non-woven webs of fibrous materials for this purpose are available in the commercial marketplace as polyester non-woven fibers coated with acrylic resin from Union Wadding of Pawtucket, R.I.; Carr Lee of Rockleigh, N.J.; Stearns Kem Wove of Charlotte, N.C.; and Loren Products of Lawrence, Mass. Such polyester non-woven webs of fibrous material are used in the present invention because of their durability, adhesion to the components of the respective aqueous mixtures, because they act to reduce shrinkage during the secondary drying steps in the formation of the foam layer for the composite material being formed as is hereinafter described and because of the increase tensile strength they impart to thin films of the composite material, in accordance with the present invention, as those used in apparel and other products. Union Wadding supplies such preferred non-woven fibrous webs at 1½ to 3 ounces per yard (¼" to ½" thickness). These are polyester 3 and 6 denier fiber acrylic spray bonded thermoformable materials. These products are formulated to enhance thermoformability of the multi-layered composite material.

Similarly felted non-woven webs of fibrous material are also available in the commercial marketplace from Non Wovens Inc. of North Chelmsford, Mass., who supply their products 8 oz. per square yard, 0.080 thickness, 65% low melt polyester and 35% high melt polyester. These felted non-woven webs of fiber material provide the same improved characteristics to the foam layer of the composite material in accordance with the present invention as has been above described.

It should be noted that in some embodiments non-woven materials are introduced as a component of the polyurethane foam layer, rather than being bonded to the foam layer as a discrete third layer. The addition of the nonwoven material within the foam layer adds strength, minimizes shrinkage in drying and acts as a wick for moisture transpiration into the foam layer. Such foam layers are formed by depositing the polymerizing foam onto a non-woven fiber web and compressing the foam-coated web to 10% of its thickness, thus coating the fibers of the web with the polymerized foam containing interstitial voids.

In an embodiment of an orthotic device, bladder 60 is used in accordance with certain guidelines, including Medicare requirements. These guidelines may change from year to year and bladder 60 and in some embodiments the shoe into which bladder 90 is inserted changes to conform to the guidelines.

The following examples describe various applications of bladder 60 as used in other shoes.

Example 1—Drop-In Construction

Figure 7:
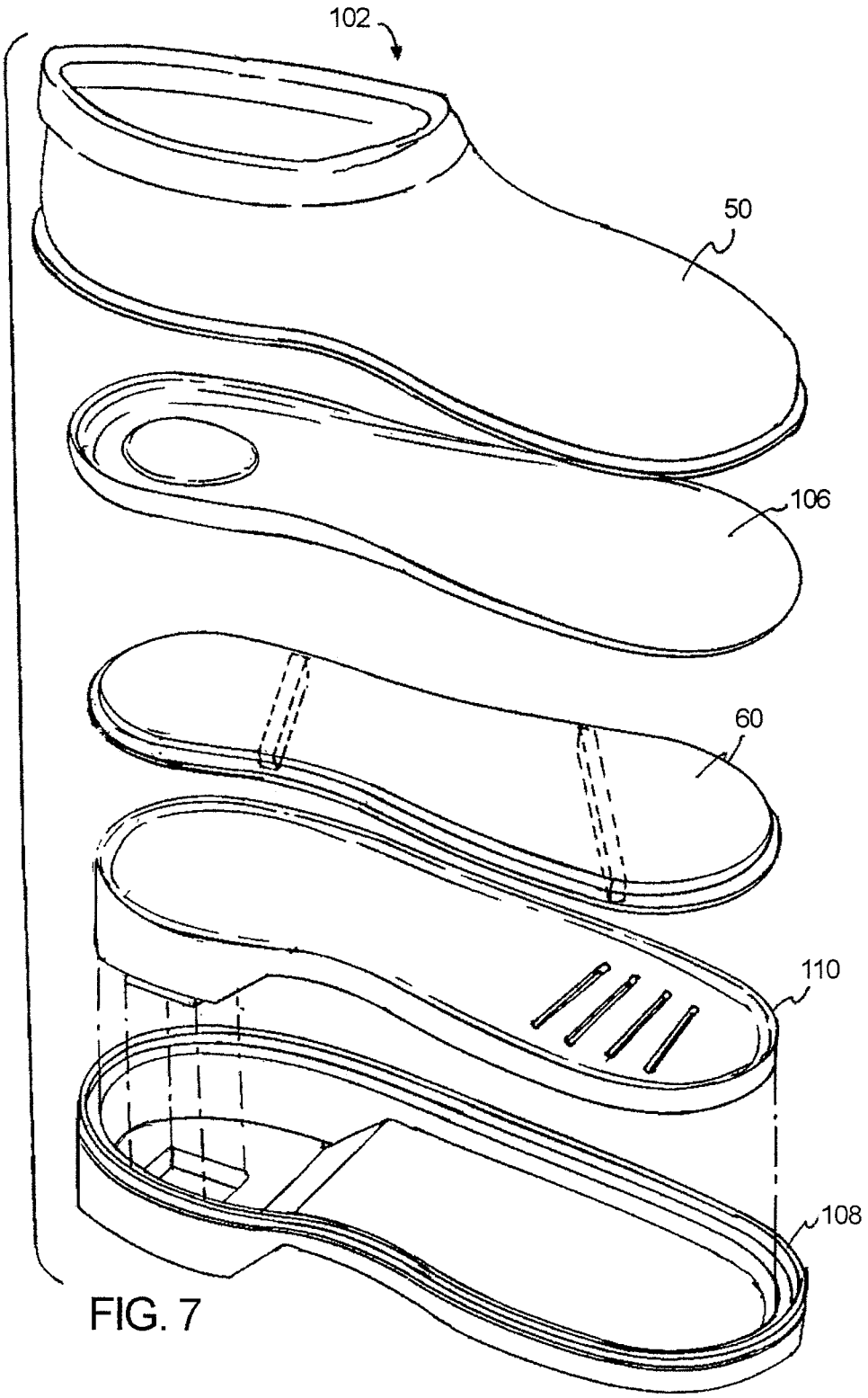
FIG. 7 depicts an application of the bladder shown in FIG. 2A, which comprises the liner shown in FIG. 1A in a shoe in accordance one embodiment of the invention.

As shown in FIG. 7, the drop-in construction shoe 102 includes footbed 106, outsole 108, spacer 110 placed on top of outsole 108 for providing structural integrity to shoe 102, and bladder 60 placed between ancillary footbed 106 and spacer 110. In another embodiment, bladder 60 is placed on top of ancillary footbed 106. Alternatively, in some embodiments ancillary footbed 106 is eliminated since bladder 60 provides cushioning to the foot. Moreover, in addition to integrity, spacer 110 provides some cushioning to shoe 102.

Example 2—Stitch and Turn Construction

Figure 8:
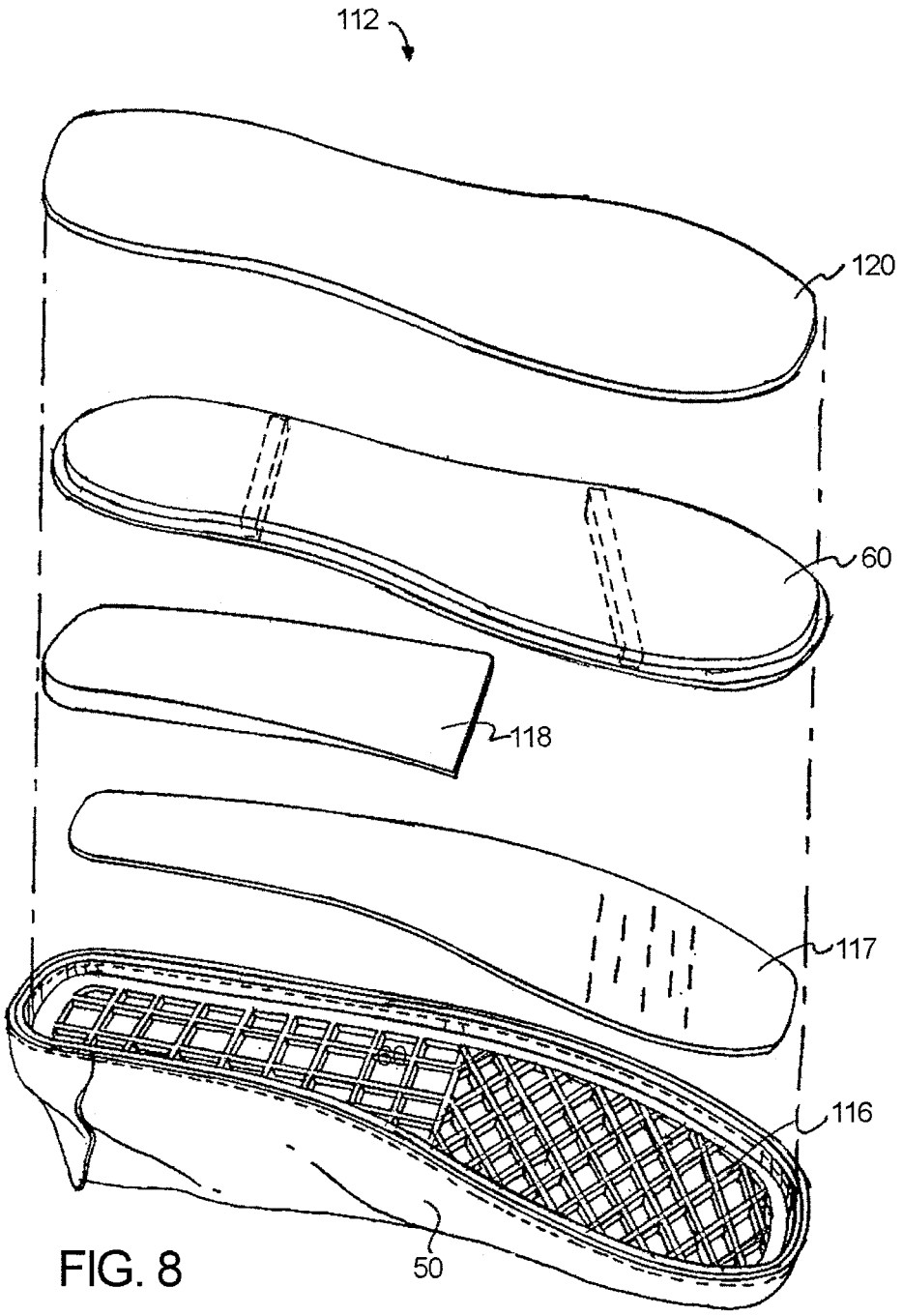
FIG. 8 depicts another application of the bladder shown in FIG. 2A, which comprises the liner shown in FIG. 1A in a shoe in accordance one embodiment of the invention.

As shown in FIG. 8, the stitch and turn construction shoe 112 includes outsole 116, insole board 117 for providing integrity to shoe 112 and a level surface upon which the user's foot can rest, spacer 118 to raise the user's heel to a comfortable height, and ancillary footbed 120 to cushion the foot. Bladder 60 is thereafter placed between ancillary footbed 120 and spacer 118. In another embodiment, bladder 60 is placed on top of foot bed 120. In the alternative, in some embodiments bladder 60 replaces ancillary footbed 120, and in other embodiments is placed between spacer 118 and insole board 117.

Example 3—Moccasin Construction

Figure 9:
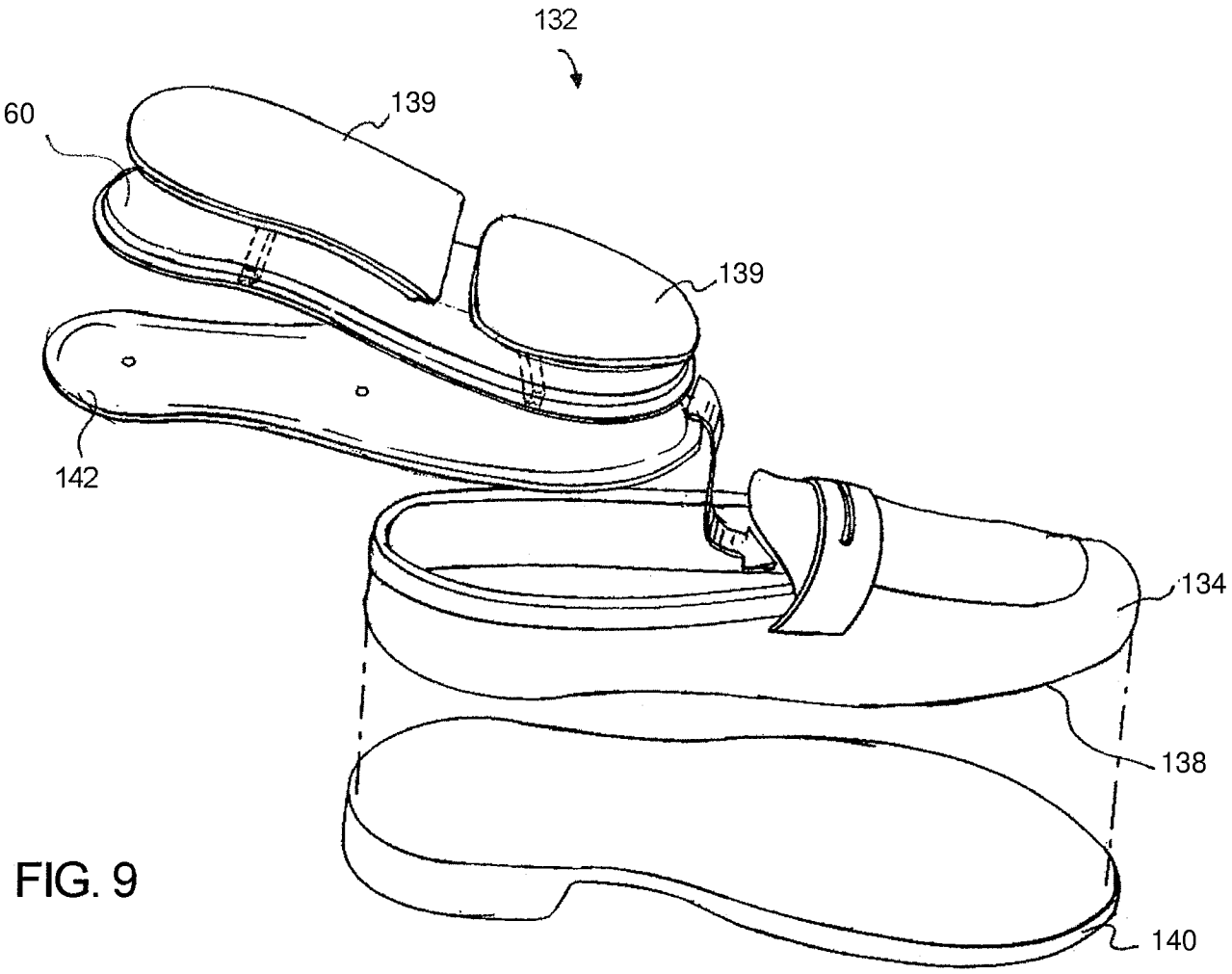
FIG. 9 depicts another application of the bladder shown in FIG. 2A, which comprises the liner shown in FIG. 1A in a shoe in accordance one embodiment of the invention.

As shown in FIG. 9, the moccasin construction shoe 132 includes upper 134 that extends under and around the bottom of where a user's foot would be, this part of upper 134 being called vamp 138. Outsole 140 is then attached to a bottom of vamp 138. Optionally, cushion 142 is placed on a top of vamp 138. Auxiliary sockling 139 would then be placed on top of cushion 142 to protect cushion 142 from wear and enhance comfort to the foot. In the event optional cushion 142 is utilized, bladder 60 is placed between cushion 142 and auxiliary sockling 139. In another embodiment, bladder 60 is placed between cushion 142 and vamp 138. In a further embodiment, bladder 60 is used instead of cushion 142. In the event bladder 60 shown in FIG. 6 is employed, In some embodiments auxiliary sockling 139 is eliminated in the embodiments cushion 142 is eliminated.

Example 4—Opanka Construction

Figure 10:
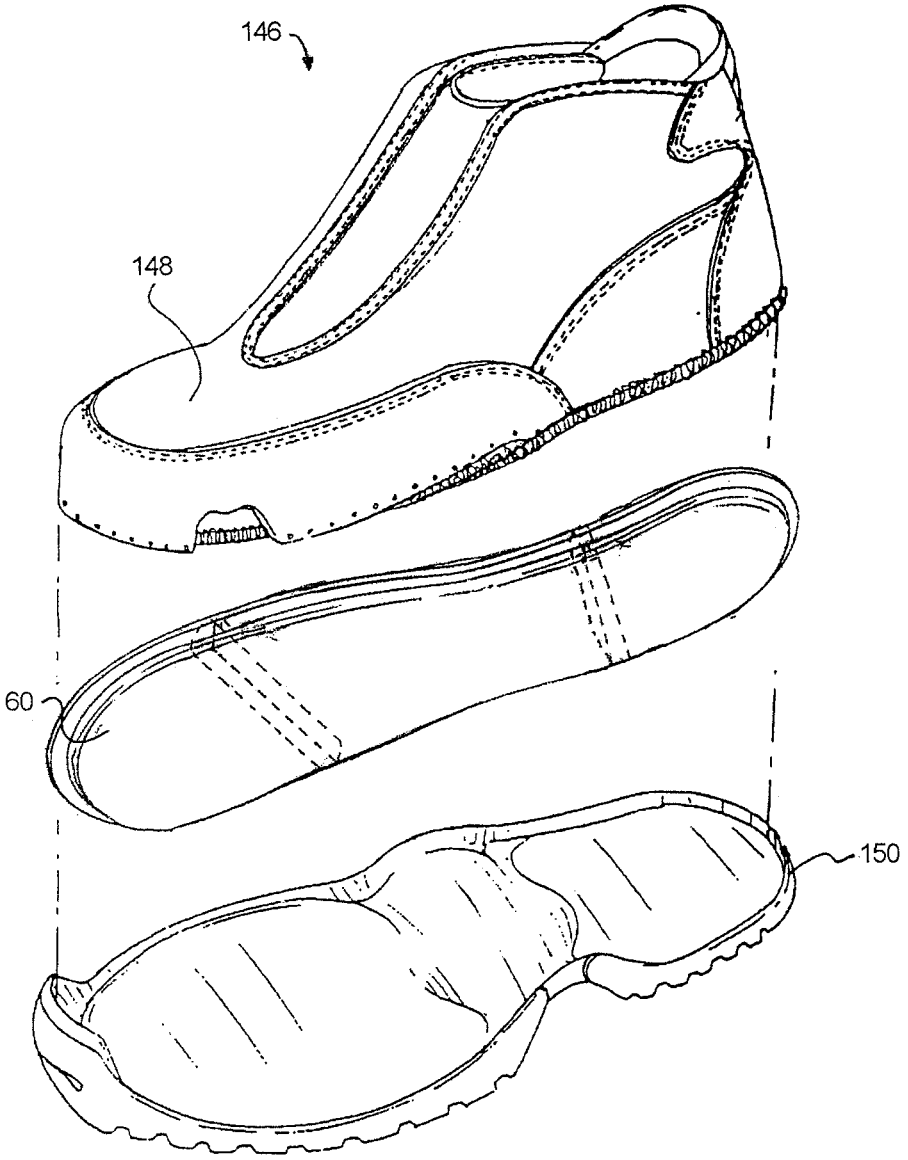
FIG. 10 depicts another application of the bladder shown in FIG. 2A, which comprises the liner shown in FIG. 1A in a shoe in accordance one embodiment of the invention.

As shown in FIG. 10, the Opanka construction shoe 146 includes upper 148, bladder 60, and sole 150 all hand sewn together in a single sewing operation. In some embodiments an auxiliary sockling is also used and sewn on top of bladder 60 in the same stitching operation. In some embodiments in the event the embodiment of bladder 60 shown in FIG. 6 is used, the auxiliary sockling is eliminated. As shown, the stitch is sewn around the entire perimeter of upper 148, bladder 60, sole 150, and the optional auxiliary sockling (auxiliary sockling not shown but the auxiliary sockling has the same limitations as the above described auxiliary socklings).

It is to be understood that the above description is provided only for demonstrative purposes, and the spirit and scope of the invention is to be interpreted as set forth in the claims.

What is claimed is:

1. A footwear product comprising:

a plurality of inserts that are reversibly placeable on a footbed of a piece of footwear;

wherein each of said inserts comprise a top and a bottom;

wherein at least one of said plurality of inserts further comprises a bladder;

wherein said bladder comprises at least one chamber which is filled with at least one filler;

wherein each top comprises at least two functional outer surfaces which are separate from one another and wherein each said bottom comprises at least two functional outer surfaces which are separate from one another;

the outer surfaces of each insert defining a profile analogous with the shape of a foot such that each insert may be oriented with any one of the multiple functional outer surfaces in contact with a foot of a wearer of the piece of footwear and an opposite one of the multiple functional outer surfaces in contact with the footbed of the piece of footwear;

wherein the outer surfaces of each respective one of the plurality of inserts have different properties;

wherein each one of the plurality of inserts has a unique combination of outer surfaces that is different from each other one of the plurality of inserts;

wherein said bladder further comprises at least one baffle which inhibits movement of said at least one filler.

2. The footwear product according to claim 1, wherein said bladder comprises multiple chambers and wherein said at least one baffle is located in at least one of said multiple chambers.

3. The footwear product according to claim 1, wherein said bladder comprises a longitudinal axis, and wherein said at least one baffle is placed at an angle relative to said longitudinal axis.

4. The footwear product according to claim 3, further comprising multiple baffles which are all at different angles from one another.

5. The footwear product according to claim 1, further comprising a permeable membrane in said bladder which separates a first and a second chamber.

6. A footwear product comprising:

an insert that is removably affixed to a footbed of a piece of footwear;

wherein said insert is a bladder which is filled with at least one filler;

said insert comprising at least one affixing mechanism;

said insert comprising a top and a bottom;

wherein said top comprises at least two functional outer surfaces which are separate from one another;

wherein said bottom comprises at least two functional outer surfaces which are separate from one another;

wherein said functional outer surfaces all have different physical characteristics from each other;

wherein said insert has an outer profile which generally matches the shape of a foot and can be removably affixed to said footbed with said top in contact with said footbed or said bottom in contact with said footbed;

wherein said bladder further comprises at least one baffle which inhibits movement of said at least one filler.

7. The footwear product according to claim 6, wherein said affixing mechanism is selected from the group consisting of magnet, strap, hook, pile, hole, and combinations thereof.

8. The footwear product according to claim 6, wherein said affixing mechanism affixes said insert to said piece of footwear when said top is engaged with said piece of footwear and when said bottom is engaged with said piece of footwear.

9. The footwear product according to claim 6, wherein said top further comprises at least three functional outer surfaces which are separate from one another.

10. The footwear product according to claim 6, further comprising said piece of footwear.

11. The footwear product according to claim 6, further comprising a membrane in said bladder which separates a first and a second chamber.

12. The footwear product according to claim 11, wherein said membrane extends from a toe area to a heel area.

* * * * *